US007137169B2

(12) United States Patent
Murphy et al.

(10) Patent No.: US 7,137,169 B2
(45) **Date of Patent: *Nov. 21, 2006**

(54) VACUUM CLEANER WITH CLEANING PAD

(75) Inventors: John S. Murphy, Brookpark, OH (US); David Khalil, Highland Hts., OH (US); Michael F. Wright, Stow, OH (US); Robert A. Matousek, Lakewood, OH (US); Craig M. Saunders, Rocky River, OH (US); Jeffrey M. Kalman, Cleveland Heights, OH (US); Chun Ming Ho, Hong Kong (HK); Kiyoshi Yokote, Kashiwa (JP)

(73) Assignee: Royal Appliance Mfg. Co., Glenwillow, OH (US)

( * ) Notice: Subject to any disclaimer, the term of this patent is extended or adjusted under 35 U.S.C. 154(b) by 343 days.

This patent is subject to a terminal disclaimer.

(21) Appl. No.: 10/340,247

(22) Filed: Jan. 10, 2003

(65) Prior Publication Data

US 2004/0134025 A1 Jul. 15, 2004

(51) Int. Cl.
*A47L 11/30* (2006.01)

(52) U.S. Cl. ..... 15/320; 15/344; 15/403

(58) Field of Classification Search ..... 15/320, 15/323, 328, 339, 350–352, 363, 393, 400, 15/403, 410

See application file for complete search history.

(56) References Cited

U.S. PATENT DOCUMENTS

| | | | | |
|---|---|---|---|---|
| 1,066,201 | A | 7/1913 | Fulper | |
| 1,657,111 | A | 1/1928 | Desnoyers | |
| 1,978,579 | A | 10/1934 | Hooks | |
| 2,012,287 | A | 8/1935 | Replogle et al. | |
| 2,064,903 | A | 12/1936 | Ghignatti | |
| 2,091,290 | A | 8/1937 | Replogle | |
| 2,564,339 | A | 8/1951 | Nerheim | |
| 2,821,733 | A | 2/1958 | Kasper | |
| 2,873,465 | A | 2/1959 | Miller | |
| 2,893,048 | A | 7/1959 | Martinec | |
| 3,273,194 | A * | 9/1966 | Jepson et al. | 15/323 |
| 3,667,084 | A * | 6/1972 | Valbona et al. | 15/323 |
| 3,745,605 | A * | 7/1973 | Gitschel et al. | 15/400 |
| 3,833,962 | A | 9/1974 | Krusche | |
| 4,172,710 | A | 10/1979 | van der Molen | |
| 4,249,280 | A * | 2/1981 | Goodrich | 15/323 |
| 4,266,317 | A | 5/1981 | Duda | |

(Continued)

FOREIGN PATENT DOCUMENTS

DE 297 04 742 U 10/1997

(Continued)

OTHER PUBLICATIONS

Patent Abstracts of Japan, vol. 1998, No. 13, Nov. 10, 1998 & JP 10 201697 A (Mizuno Akira; Nitto Denko Corp), Aug. 4, 1998.

*Primary Examiner*—Terrence R. Till
(74) *Attorney, Agent, or Firm*—Fay, Sharpe, Fagan, Minnich & McKee, LLP

(57) ABSTRACT

A vacuum cleaner has a suction nozzle, a housing connected to the suction nozzle and a suction fan and motor assembly mounted to the housing. A dirt collecting receptacle is mounted to the housing and is in communication with the suction nozzle and suction fan and motor assembly. A support plate is pivotally mounted to the housing and selectively holds a cleaning sheet for collecting dust and debris from a surface to be cleaned.

48 Claims, 16 Drawing Sheets

U.S. PATENT DOCUMENTS

| | | | | |
|---|---|---|---|---|
| 4,311,493 | A * | 1/1982 | Schaefer et al. | 55/369 |
| 4,665,582 | A | 5/1987 | Richmond et al. | |
| 4,833,752 | A | 5/1989 | Merrick | |
| 5,020,186 | A | 6/1991 | Lessig, III et al. | |
| 5,060,342 | A | 10/1991 | Brazier | |
| 5,074,008 | A | 12/1991 | Palomino, Jr. | |
| 5,107,567 | A | 4/1992 | Ferrari et al. | |
| 5,167,045 | A | 12/1992 | Rodriguez | |
| D338,705 | S | 8/1993 | Spokoiny | |
| 5,392,491 | A | 2/1995 | Hwang et al. | |
| 5,399,381 | A | 3/1995 | Randall | |
| 5,400,467 | A | 3/1995 | Hwang | |
| 5,557,823 | A | 9/1996 | Rouda | |
| 5,603,139 | A | 2/1997 | Alazet | |
| 5,659,922 | A | 8/1997 | Louis | |
| 5,697,119 | A | 12/1997 | Mussalo | |
| 5,713,103 | A | 2/1998 | Keebler et al. | |
| 5,779,745 | A | 7/1998 | Kilstrom | |
| 5,819,366 | A | 10/1998 | Edin | |
| 5,888,006 | A | 3/1999 | Ping et al. | |
| D409,343 | S | 5/1999 | Kingry et al. | |
| 5,909,755 | A | 6/1999 | Leal | |
| 5,960,508 | A | 10/1999 | Holt et al. | |
| 5,988,920 | A | 11/1999 | Kunkler et al. | |
| 6,003,191 | A | 12/1999 | Sherry et al. | |
| 6,017,163 | A | 1/2000 | Keppers et al. | |
| D420,561 | S | 2/2000 | Kunkler | |
| D423,742 | S | 4/2000 | Kingry et al. | |
| 6,045,622 | A | 4/2000 | Holt et al. | |
| 6,048,123 | A | 4/2000 | Holt et al. | |
| 6,065,182 | A | 5/2000 | Wright et al. | |
| 6,070,288 | A * | 6/2000 | Luyckx et al. | 15/323 |
| 6,101,661 | A | 8/2000 | Policicchio et al. | |
| 6,101,668 | A | 8/2000 | Grey | |
| 6,108,864 | A * | 8/2000 | Thomas et al. | 15/350 |
| 6,142,750 | A | 11/2000 | Benecke | |
| 6,146,434 | A | 11/2000 | Scalfani et al. | |
| 6,243,909 | B1 | 6/2001 | Graham et al. | |
| 6,243,912 | B1 * | 6/2001 | Grey | 15/320 |
| 6,305,046 | B1 | 10/2001 | Kingry et al. | |
| 6,328,543 | B1 | 12/2001 | Benecke | |
| 6,334,233 | B1 | 1/2002 | Roberts et al. | |
| 6,347,428 | B1 | 2/2002 | Shimko et al. | |
| 6,353,964 | B1 | 3/2002 | Andrisin, Jr. et al. | |
| 6,380,151 | B1 | 4/2002 | Masters et al. | |
| 6,386,392 | B1 | 5/2002 | Argentieri et al. | |
| D458,427 | S | 6/2002 | Kunkler et al. | |
| 6,474,896 | B1 | 11/2002 | DeLaine, Jr. | |
| 6,626,332 | B1 * | 9/2003 | Ehrensperger et al. | 222/190 |
| D487,324 | S | 3/2004 | Santiago et al. | |
| D494,721 | S | 8/2004 | Kotani | |
| 2001/0023517 | A1 * | 9/2001 | Onishi et al. | 15/351 |
| 2001/0047559 | A1 | 12/2001 | Graham et al. | |
| 2002/0042962 | A1 | 4/2002 | Willman et al. | |
| 2002/0050016 | A1 | 5/2002 | Willman et al. | |
| 2002/0066153 | A1 | 6/2002 | Sciafani et al. | |
| 2002/0194693 | A1 * | 12/2002 | Wu | 15/322 |
| 2003/0163887 | A1 * | 9/2003 | Inoue | 15/353 |
| 2004/0031121 | A1 | 2/2004 | Martin et al. | |
| 2004/0045126 | A1 * | 3/2004 | Parker et al. | 15/403 |
| 2004/0134016 | A1 * | 7/2004 | Kisela et al. | 15/320 |
| 2004/0139572 | A1 * | 7/2004 | Kisela et al. | 15/320 |
| 2004/0168281 | A1 | 9/2004 | Sako et al. | |
| 2004/0250376 | A1 | 12/2004 | Hori et al. | |

FOREIGN PATENT DOCUMENTS

| | | | |
|---|---|---|---|
| DE | 201 03 268 | U1 | 6/2001 |
| EP | 0 370 698 | A1 | 5/1990 |
| EP | 0 625 331 | B1 | 8/1997 |
| EP | 1 027 855 | A2 | 8/2000 |
| GB | 741 136 | A | 11/1955 |
| GB | 2078496 | | 1/1982 |
| JP | 09-28638 | * | 2/1997 |
| JP | 10-52386 | | 2/1998 |
| JP | 11-253369 | | 9/1999 |
| WO | WO 98/23200 | | 6/1998 |
| WO | WO 01/72195 | A1 | 10/2001 |

* cited by examiner

VACUUM CLEANER WITH CLEANING PAD

FIELD OF THE INVENTION

The present invention relates to vacuum cleaners. More particularly, the present invention relates to a stick-type or hand-held vacuum cleaner which is combined with a cleaning pad having a removable cleaning sheet.

BACKGROUND OF THE INVENTION

Stick vacuum cleaners are well known in the art. These vacuum cleaners are typically more lightweight than traditional upright cleaners and lack the driven brushrolls of traditional cleaners. The lighter weight and lack of a brushroll allows these cleaners to be more easily manipulated by a user. They can also be employed on a wider variety of surfaces than traditional upright cleaners.

For example, stick vacuum cleaners are often used on non-carpeted floor surfaces where a brushroll may damage the floor surface. The stick vacuum cleaner is also often used for surfaces with hard-to-reach areas or elevated surfaces. The lighter weight and more compact design of a stick vacuum compared to a traditional upright vacuum leads to greater maneuverability and ease of lifting.

As with any other vacuum cleaner, dirt-laden air is drawn into a stick vacuum cleaner through a nozzle by a suction that is created by a suction motor driving a suction fan or impeller. The dirt-laden air passes into a dirt collection receptacle such as a dirt cup or filter bag. The dirt is held in the receptacle and the air is exhausted.

An alternative to stick vacuum is the hand-held vacuum cleaner. Some hand held vacuum cleaners employ a powered rotary brush while others merely use a nozzle for suctioning dirt and debris from carpets, floors, and above floor surfaces.

Hand-held vacuum cleaners have become extremely popular for cleaning a variety of surfaces in homes, offices, cars or the like. They are utilized particularly for small pick up jobs or for cleaning in hard to reach places. By their nature, hand-held vacuum cleaner units are lightweight in order to enable a user to readily utilize them in places where canister, upright, stick or shop-type vacuum cleaners cannot be used or are inconvenient to use.

Of course, non-powered cleaning implements are also widely known. They are used for removing dust, dirt and/or liquids from hard surfaces. Brooms are one example. More recently, a cleaning implement which comprises a handle and a cleaning pad with a removable cleaning sheet has become popular for cleaning dry surfaces. The cleaning sheets exhibit the ability to pick up dust and debris from the surface to be cleaned. Once dirty, the sheet is discarded and replaced with a clean one. One such product is sold by Procter & Gamble under the trademark SWIFFER™.

This product uses non-woven sheets for dry dust-type cleaning. Such sheets typically utilize a composite of fibers where the fibers are bonded by adhesive, or are entangled in other ways. See for example U.S. Pat. Nos. 3,629,047 and 5,144,729. To provide durable wiping sheets, reinforcement means are combined with staple fibers in the form of continuous filament or network structure. Such cleaning sheets maximize the surface of the sheet and have electrostatic properties for collecting and/or attracting particulate dirt.

However, cleaning implements that comprise a removable cleaning sheet are not able to successfully remove larger debris or particles from the surface to be cleaned. Such debris may include animal hair or fur, dirt, sand or small pebbles brought in from outdoors, food crumbs or other larger particles of debris.

Thus, it would be advantageous to provide a cleaning product which combines the features of a vacuum cleaner such as a stick-type vacuum cleaner or a hand-held vacuum cleaner with a cleaning pad that comprises a removable cleaning sheet. Accordingly, it is desirable to develop a new and improved cleaning product which would overcome the foregoing difficulties and others and provide a cleaning pad in combination with a vacuum cleaner.

SUMMARY OF THE INVENTION

The present invention relates to a vacuum cleaner. In particular, the present invention relates to a vacuum cleaner having a cleaning pad with a sheet attached thereto. In a first embodiment of the present invention, the vacuum cleaner comprises a suction nozzle, a housing connected to the suction nozzle, a suction fan and motor assembly mounted to the housing, and a dirt collecting receptacle mounted to the housing and in communication with the suction nozzle and the suction fan and motor assembly. A support plate is pivotally mounted to the housing for selectively holding a cleaning sheet for collecting dust and debris from a surface to be cleaned.

In accordance with another embodiment of the present invention, the vacuum cleaner comprises a support plate selectively holding a cleaning sheet, a handle pivotally connected to the support plate, a housing mounted to one of the handle and support plate, and a suction fan and motor assembly mounted to the housing. A dirt collecting receptacle is mounted to the housing and a suction nozzle is connected to the housing.

In another embodiment of the present invention, a vacuum cleaner comprises a suction nozzle, a housing connected to the suction nozzle, a suction fan and motor assembly mounted to the housing and a dirt collecting receptacle mounted to the housing and in communication with the suction nozzle and the suction fan and motor assembly. A handle extends from the housing for grasping to move the vacuum along a surface to be cleaned. A switch provides at least momentary operation of the suction fan and motor assembly. A support plate is pivotally mounted to the housing for selectively holding a cleaning sheet for collecting dust and debris from the surface to be cleaned.

In accordance with a further embodiment of the present invention, a cleaning device having two separate and distinct selected modes of operation is provided. A first mode of operation comprises suctioning debris from a surface to be cleaned, and a second mode of operation comprises use of a cleaning sheet to collect dust and debris from the surface to be cleaned. The cleaning device comprises a housing, a suction fan and motor assembly mounted to the housing, a dirt collecting receptacle mounted to the housing, a suction nozzle communicating with the suction fan and motor assembly and the dirt receptacle for performing the first mode of operation. A support plate is pivotably mounted to the housing and selectively holds a cleaning sheet for performing the second mode of operation.

In accordance with yet another embodiment of the present invention, a vacuum cleaner comprises a housing, a suction fan and motor mounted within the housing, a handle connected to the housing and first and second cleaning implements each pivotally connected to the housing. A dirt collecting receptacle is mounted to the housing and is in communication with the suction fan and motor assembly.

BRIEF DESCRIPTION OF THE DRAWINGS

The invention may take form in certain components and structures, several preferred embodiments of which will be illustrated in the accompanying drawings wherein.

DETAILED DESCRIPTION OF THE EMBODIMENTS

Figure 1:
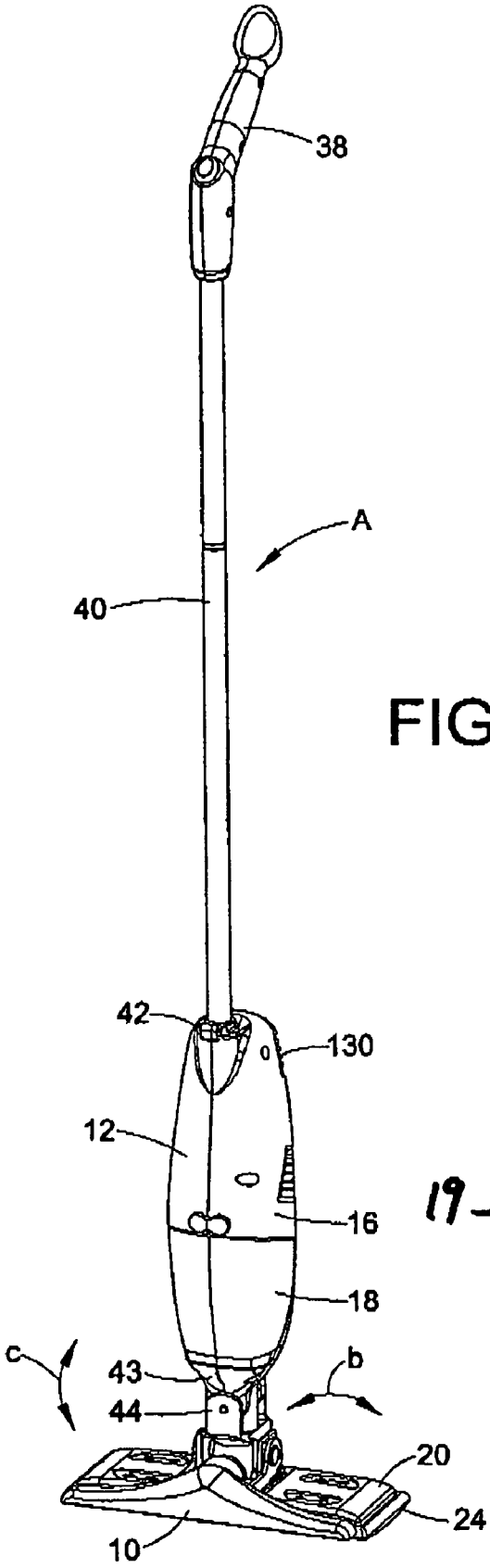
FIG. 1 is a perspective view of a stick vacuum cleaner having a cleaning pad mounted thereto according to a first embodiment of the present invention.

Referring now to the drawings, wherein the showings are for purposes of illustrating several preferred embodiments of this invention only and not for purposes of limiting same, FIG. 1 shows a vacuum cleaner A according to a first embodiment of the present invention.

Figure 1A:
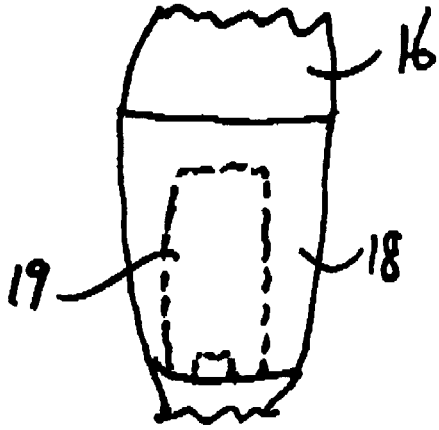
FIG. 1A is an enlarged breakaway view of a dust collection receptacle of the stick vacuum cleaner of FIG. 1 having a filter bag therein.

The vacuum cleaner A is illustrated to be of the stick-type and includes a suction nozzle 10, a housing 12 connected to the suction nozzle, a suction fan and motor assembly 16 (FIG. 7) which is mounted to the housing, and a dirt collecting receptable 18 which is also mounted to the housing and is in communication with the suction nozzle and suction fan and motor assembly. Referring to FIG. 1A, the dirt collecting recentacle 18 can include a conventional filter bag 19 mounted therein, which is well known in the art and will not be described in detail herein. A support plate 20 is also connected to the housing and selectively holds a disposable cleaning sheet 30 (FIG. 10) for collecting dust and debris from a surface to be cleaned.

The vacuum cleaner further includes a handle 40 which extends from a first end 42 of the housing. A grip 38 extends from a distal end of the handle. The support plate or cleaning pad member 20 can be mounted to the housing at a housing second end 43 by a pivotable joint, such as a conventional universal joint 44, which interconnects the housing with the support plate. As is well known, the universal joint allows the housing and the handle to pivot along two rotational axes "b" and "c".

Figure 2:
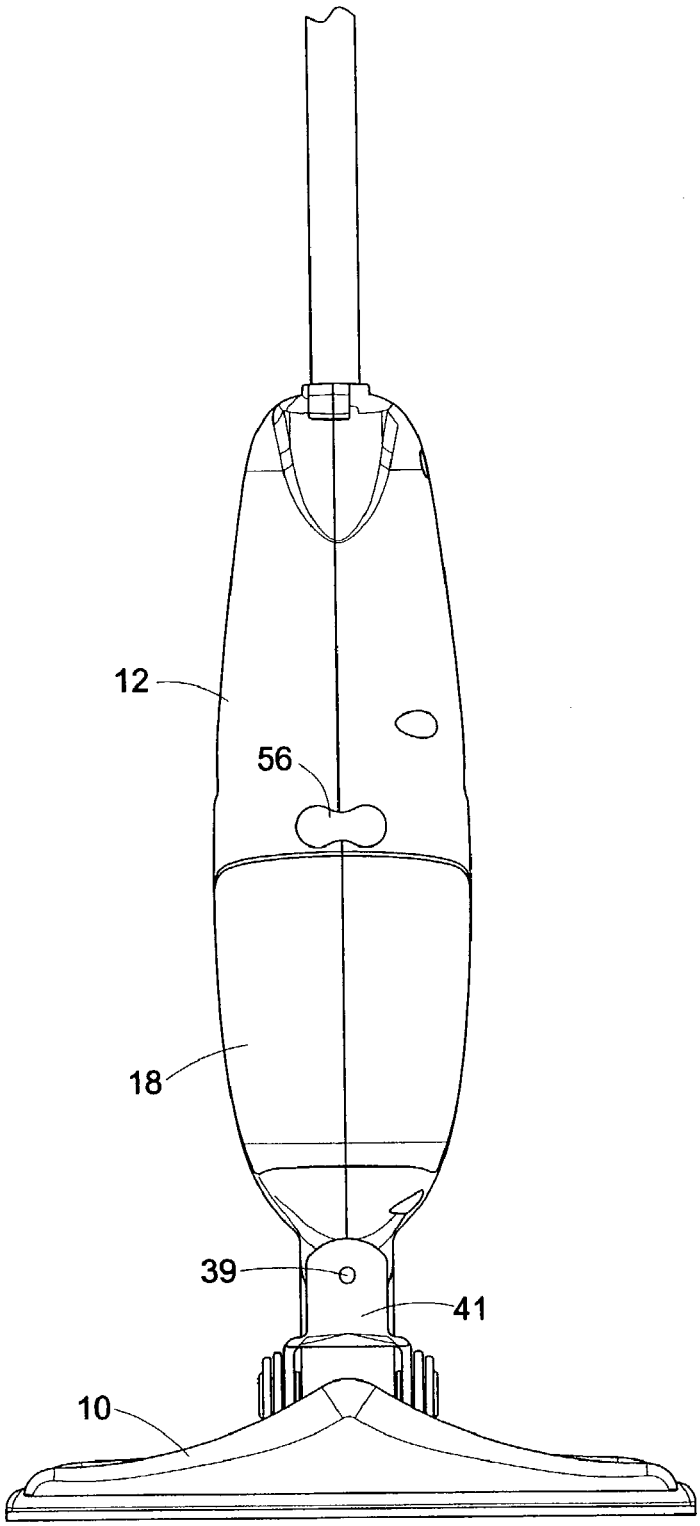
FIG. 2 is a front elevational view of the vacuum cleaner of FIG. 1.
Figure 3:
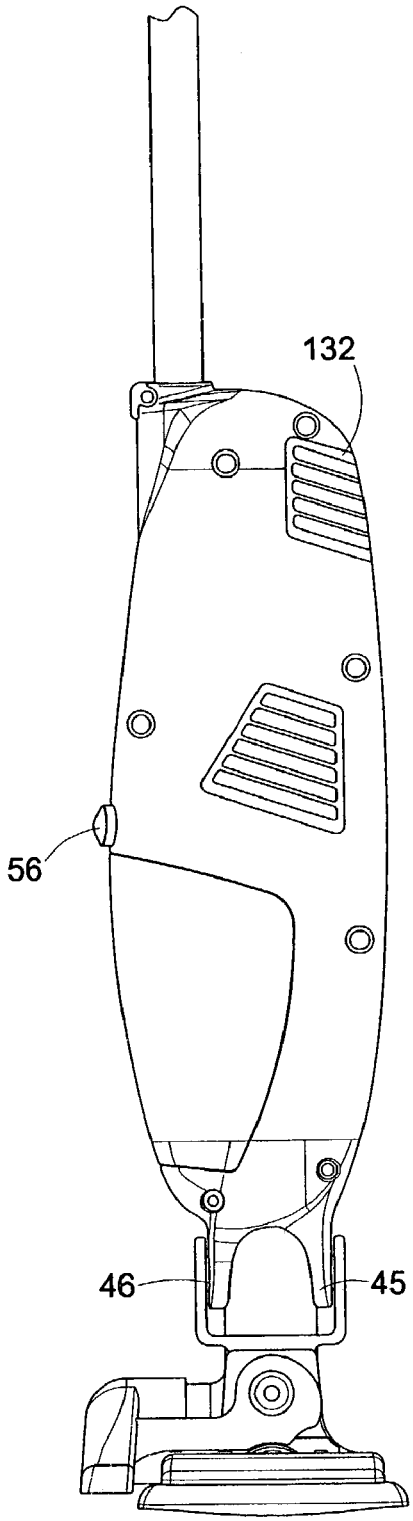
FIG. 3 is a side elevational view of the vacuum cleaner of FIG. 1.

With reference now to FIGS. 2 and 3, the housing 12 is mounted to a first fork 41 of the universal joint via spaced apart and generally parallel flanges 45, 46 of the housing. Pins 39 extend through aligned holes in the flanges 45, 46 and the fork 41 for pivotably mounting the housing to the universal joint.

Figure 10:
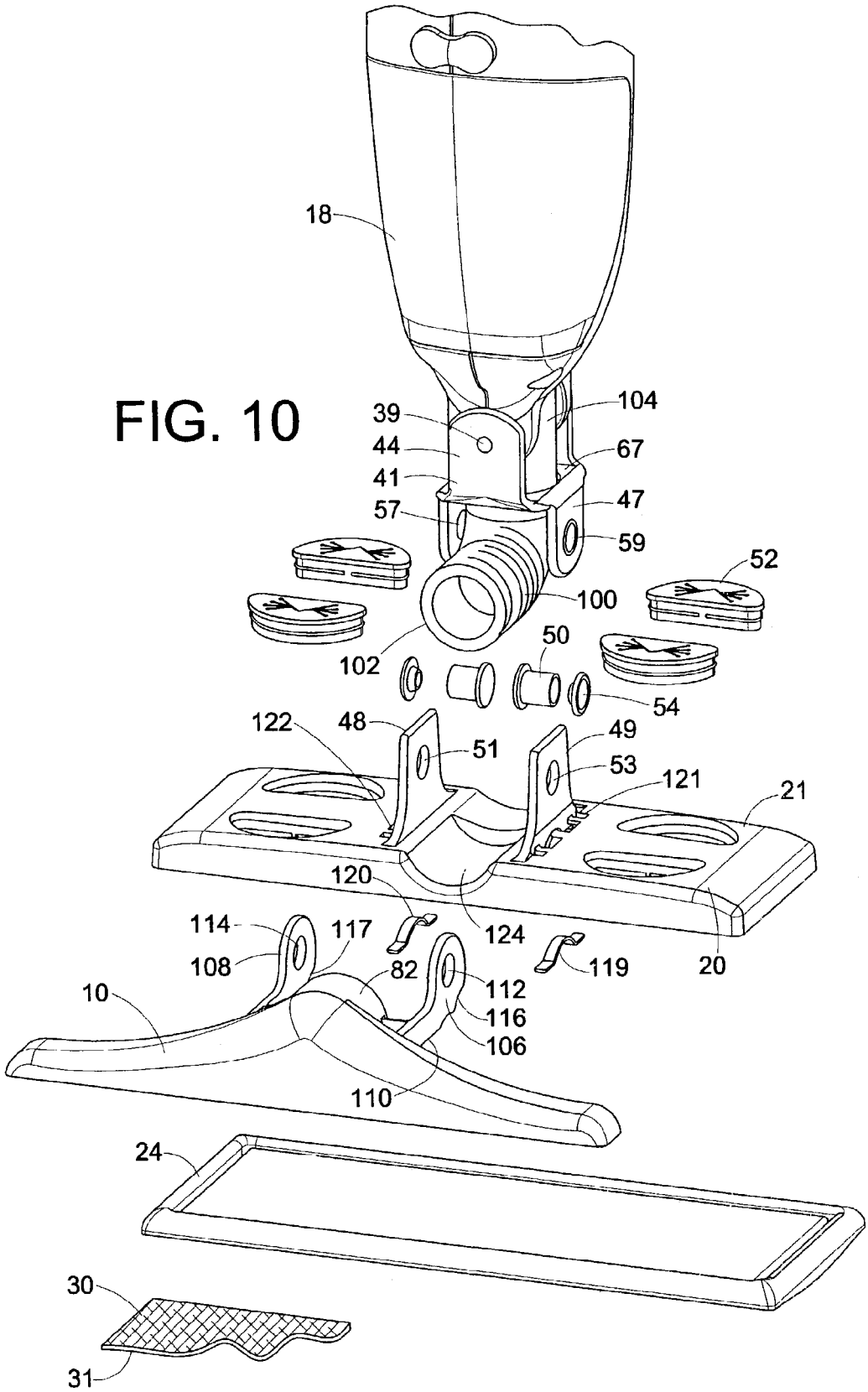
FIG. 10 is an exploded perspective view of a lower portion of the vacuum cleaner of FIG. 1.

Referring to FIG. 10, the universal joint has a second fork 47 which is interconnected with the support plate at spaced apart flanges 48, 49 of the support plate for pivotably securing the support plate to the housing. The second fork 47 has a rotational axis perpendicular to the axis of the first fork 41. Flanges 48, 49 are interconnected with fork 47 via dowel pins or plugs 50 which extend through holes 51, 53 of the connecting members and holes 57, 59 of the second rotational joint. Caps or seals 54 secure the pins 50 within the holes of the connecting members and joint 47. The two forks 41 and 47 can be secured to each other along a base plate 67 thereof by conventional means, such as gluing, welding or the like, depending on the material from which the forks are made. Alternatively, the entire joint member can be of one piece.

With continued reference to FIG. 10, the support plate 20 comprises a plurality of attachment structures or slitted attachment clips 52 which are configured to receive and retain the cleaning sheet 30 about the support plate during use. The clips are described in detail in U.S. Pat. No.

6,305,046, which is incorporated herein by reference in its entirety. The clips 52 are disposed adjacent the corners of the support plate, although these locations can be varied depending upon the size and shape of the support plate. The disposable cleaning sheet 30 is thus releasably attached to the support plate using the clips 52.

Figure 4:
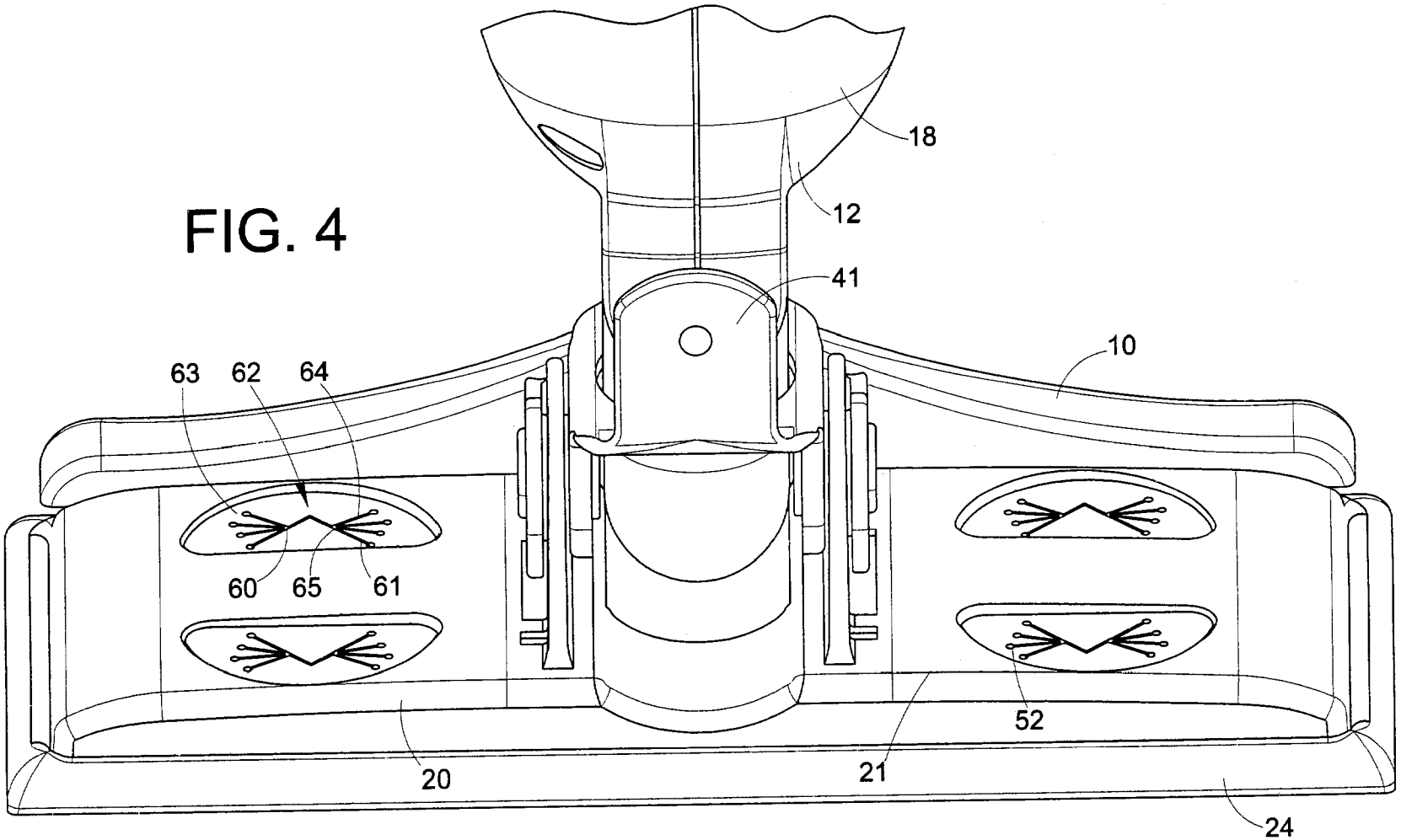
FIG. 4 is an enlarged perspective view of a support plate and a suction nozzle of the vacuum cleaner of FIG. 1.

As best seen in FIG. 4, the attachment structures each comprise a base triangle 60 which is defined along two sides thereof by slits 61 which extend through the flexible material which forms the attachment structures. An apex 62 of the base triangle is formed by the intersection of the slits 61. The attachment structures further include a plurality of pie wedge-shaped sections 63 having apexes 64 which meet at a substantially common point 65. This arrangement permits the pie wedge-shaped sections to individually deflect relative to each other under finger pressure so that a portion of the sheet can be pushed through the top surface of the attachment structures and into a cavity (not shown) formed within the attachment structures.

As the sheet is pushed past the top surface of an attachment structure or clip 52, the apexes of the pie wedge-shaped sections and the apex of the base triangle can pierce and engage the sheet 30 such that the sheet is retained about the support plate during use. As is known, the attachment structures can be formed from polyethylene by injection molding and can be retained within the support plate by a ridge (not shown) disposed on the support plate which engages a slot disposed on the attachment structure. While clips 52 are shown for selectively attaching the cleaning sheet 30 to the support plate 20, it should be appreciated that a variety of other structures can be used for the same purpose. For example, cooperating hook and loop fasteners may be provided on the support plate and the sheet. Also, an elastic band could be secured around the periphery of the sheet. The band can be smaller in its normal state than the diameter of the support plate, thus allowing the sheet to be selectively secured to and detached from the support plate simply by enlarging the band to fit it, and the periphery of the cleaning sheet, over the support plate.

Figure 6:
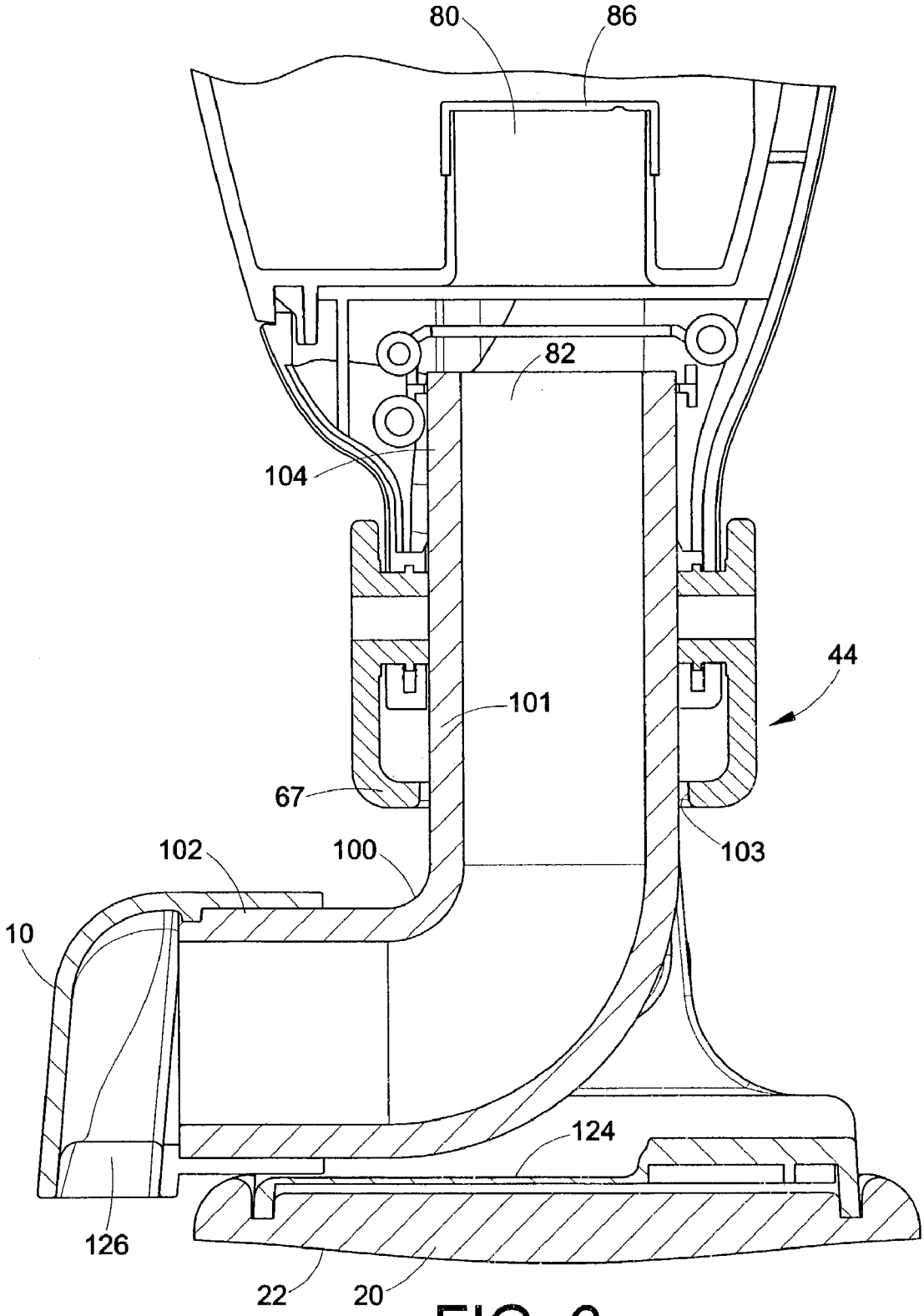
FIG. 6 is an enlarged, assembled side elevational view in cross section of the vacuum cleaner of FIG. 5 showing a hose extending through a universal joint.

The support plate includes a top surface 21 to which the clips 52 are attached and a bottom surface 22 (FIG. 6) around which extends the cleaning sheet 30. The bottom surface of the support plate engages at least a portion of the cleaning sheet during use. As shown in FIG. 6, the support plate 20 has a convex shape as is described in detail in published U.S. Patent Application No. US2002/0050016 A1, dated May 2, 2002, incorporated herein by reference in its entirety. Referring to FIGS. 4 and 10, a bumper 24 surrounds the outside edge of the support plate. The bumper can be made of foam, rubber, or another elastic or flexible material.

With reference again to FIG. 10, the removable cleaning sheet 30 comprises a scrubbing layer 31. The scrubbing layer 31 is the portion of the cleaning sheet that contacts the soiled surface during cleaning. As such, materials useful as a scrubbing layer must be sufficiently durable that the layer will retain its integrity during the cleaning process. For example, an electrostatic cloth or pad may be used. The sheets can be made of polyester or polypropylene and build a negative charge as they are rubbed over a surface. This is known in the art. Close contact transfers electrons from the dirt to the cleaning sheet, increasing its negative charge. Hair and dust particles are positively charged and are thus attracted to the sheet.

It should be appreciated that when a cleaning sheet is used in combination with a cleaning solution, an absorbent layer (not illustrated) may also be employed with the scrubbing layer in order to absorb liquids. Of course, thicker liquid absorbing sheets could also be used if desired. For example, a microfiber sheet with an internal sponge layer could be employed. Alternatively, a cleaning sheet having an absorbent layer can be wetted with a cleaning solution prior to installation on the support plate. This will ensure that the cleaning solution is deposited on the surface being cleaned and the scrubbing layer can remove additional material from the surface being cleaned. Whether the cleaning sheet is used with a cleaning solution (i.e., in a wet state) or without cleaning solution (i.e., in a dry state) the cleaning sheet will, in addition to removing particulate matter, facilitate other functions, such as polishing, dusting, and buffing the surface being cleaned. It is also conceivable that packets of pre-wetted cleaning sheets could be sold by a merchant to the customer for use with the cleaning device of the present invention. When each sheet becomes dirty, it is simply discarded and replaced by a new, clean one.

As previously discussed, a problem that exists with cleaning implements employing cleaning sheets is that the cleaning sheets cannot effectively pick up or retain larger debris, such as granular material, larger dirt particles, food crumbs, or pebbles or debris brought in from outdoors, etc. Thus, it would be convenient to have a vacuum source attached to the cleaning implement to vacuum the larger particles that the cleaning sheet cannot effectively pick up.

Figure 9:
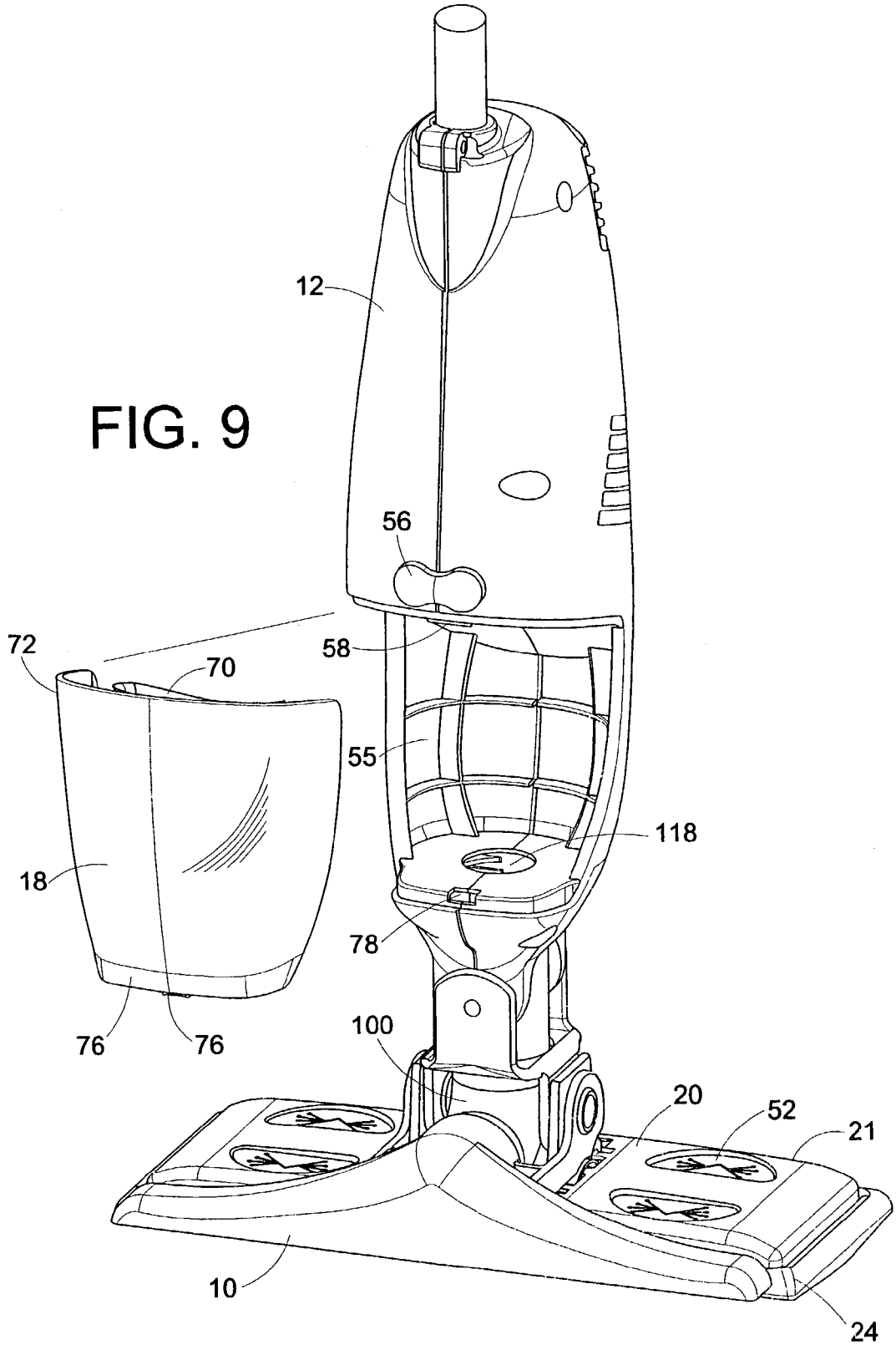
FIG. 9 is an enlarged, exploded perspective view of a lower portion of the vacuum cleaner of FIG. 1.

Thus, in a first embodiment of the present invention, a stick-type vacuum cleaner is used in combination with the support plate and cleaning sheet. In this embodiment, the dirt collecting receptacle 18 is in the form of a dirt cup. As shown in FIG. 9, the dirt cup is positioned within an opening or cavity 55 of the housing. The dirt cup is secured into place via a latch 56 or other fastening mechanism. The dirt cup can be at least partially transparent and can be fabricated from a thermoplastic material. The latch 56 releases a spring biased tab 58 from a slot 70 formed in an open first end 72 of the dirt cup.

With continued reference to FIG. 9, the dirt cup has open first end 72 and a closed second end 76. A second tab 74 extends from second end 76 of the dirt cup and engages in a corresponding cavity 78 in the housing. The latch assembly 56 facilitates the removable connection of the dirt cup to the housing. When the dirt cup is removed for cleaning, the user depresses the latch causing the tab 58 to release from the slot 70 (best shown in FIG. 7) in the dirt cup. Cleaning of the dirt cup entails removal of dirt from the dirt cup by lifting filter assembly 90 (FIG. 8) out of the dirt cup. This also allows cleaning of the filter medium or cloth or replacement of the filter assembly or the filter medium.

Figure 7:
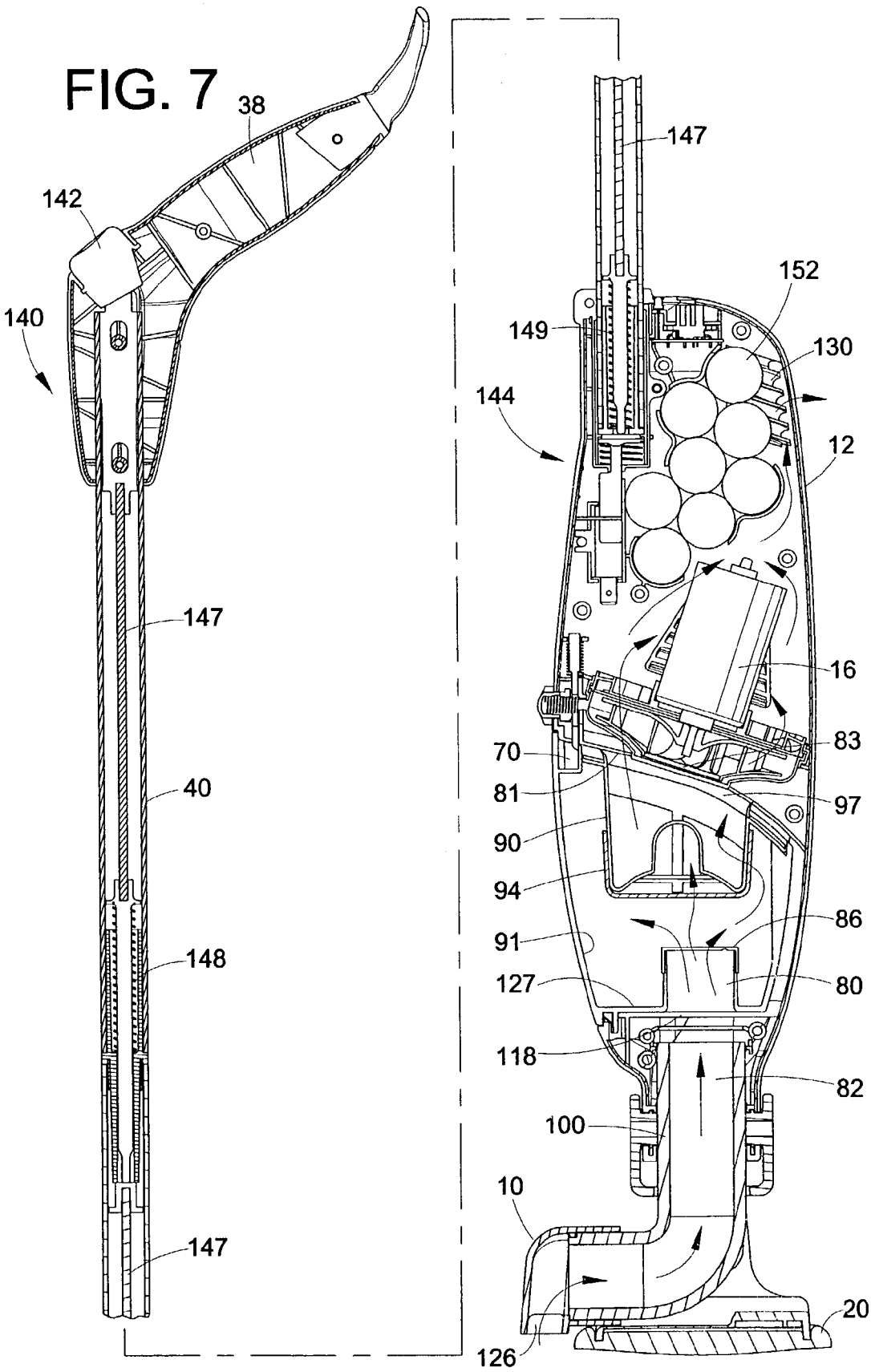
FIG. 7 is an enlarged cross-sectional view of the vacuum cleaner of FIG. 2.

Referring to FIG. 7, an inlet 80 is formed in the second end of the dirt cup and communicates with an outlet 82 of the suction nozzle. An outlet 81 is formed in the first end of the dirt cup which communicates with an inlet 83 to the suction fan and motor assembly. A flapper valve 86 prevents the dirt in the dirt cup from falling back into the suction nozzle outlet 82. The flapper valve can be made of rubber or another known flexible material.

Figure 8:
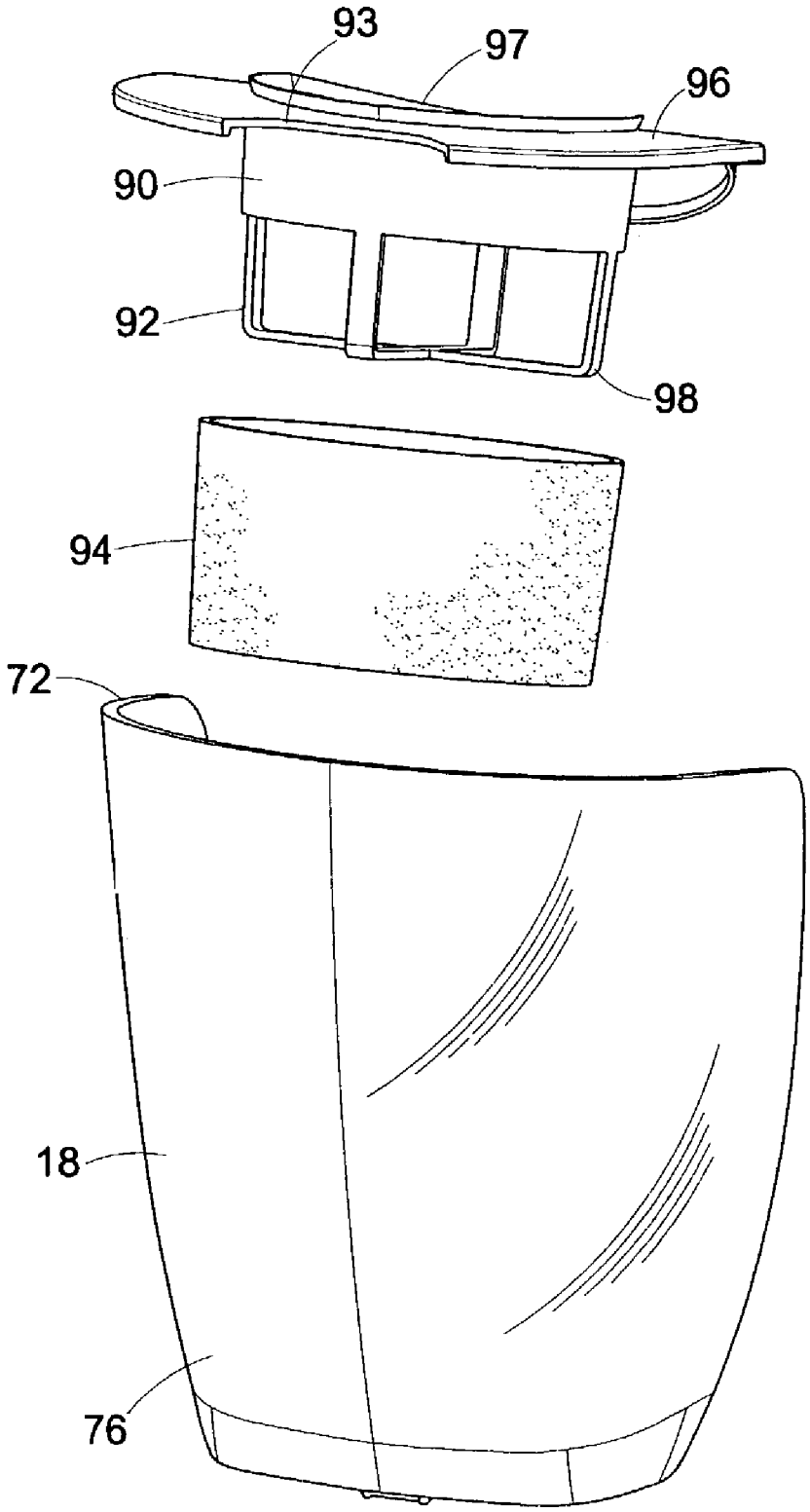
FIG. 8 is an enlarged, exploded perspective view of the dirt cup of FIG. 4.

Referring now to FIG. 8, a filter assembly 90 is removably attached to the dirt cup first end 72. The filter assembly includes a filter cage 92 upon which a filter medium 94 is mounted. In this embodiment, the filter medium can be made of a porous cloth or similar conventional material which can be glued or otherwise secured to the cage. The filter cage includes an end wall 96 on a first end thereof and an open frame 98 at a second end thereof. A filter gasket (not illustrated) can be disposed about a periphery of the upper surface of end 96. A gasket would function to seal the dirt cup cavity. Alternatively, the material of the filter cage 92 can be flexible enough to serve a gasket function for sealing the filter cage against an inner wall 91 of the dirt cup. The end wall 96 of the filter cage is keyed, as at 93, to insure that the cage can be mounted to the dirt cup 18 only in one orientation. The recess forming the key 93 accommodates the slot 70 of the dirt cup as shown in FIG. 7. The end wall 96 also includes a centrally positioned opening 97 (see also FIG. 7) through which air cleaned by the filter can flow out of the open end 81 of the dirt cup.

Referring now to FIG. 6, a conduit 100, in the form of a flexible hose in the preferred embodiment, extends between and connects the outlet of the suction nozzle 10 to the inlet 80 of the dirt cup. A first end 102 of the hose connects to the suction nozzle, a central portion 101 extends through an aperture 103 in the base plate 67 of the universal joint and a second end 104 connects to the dirt cup inlet via housing inlet 118 (FIG. 9).

Figure 5:
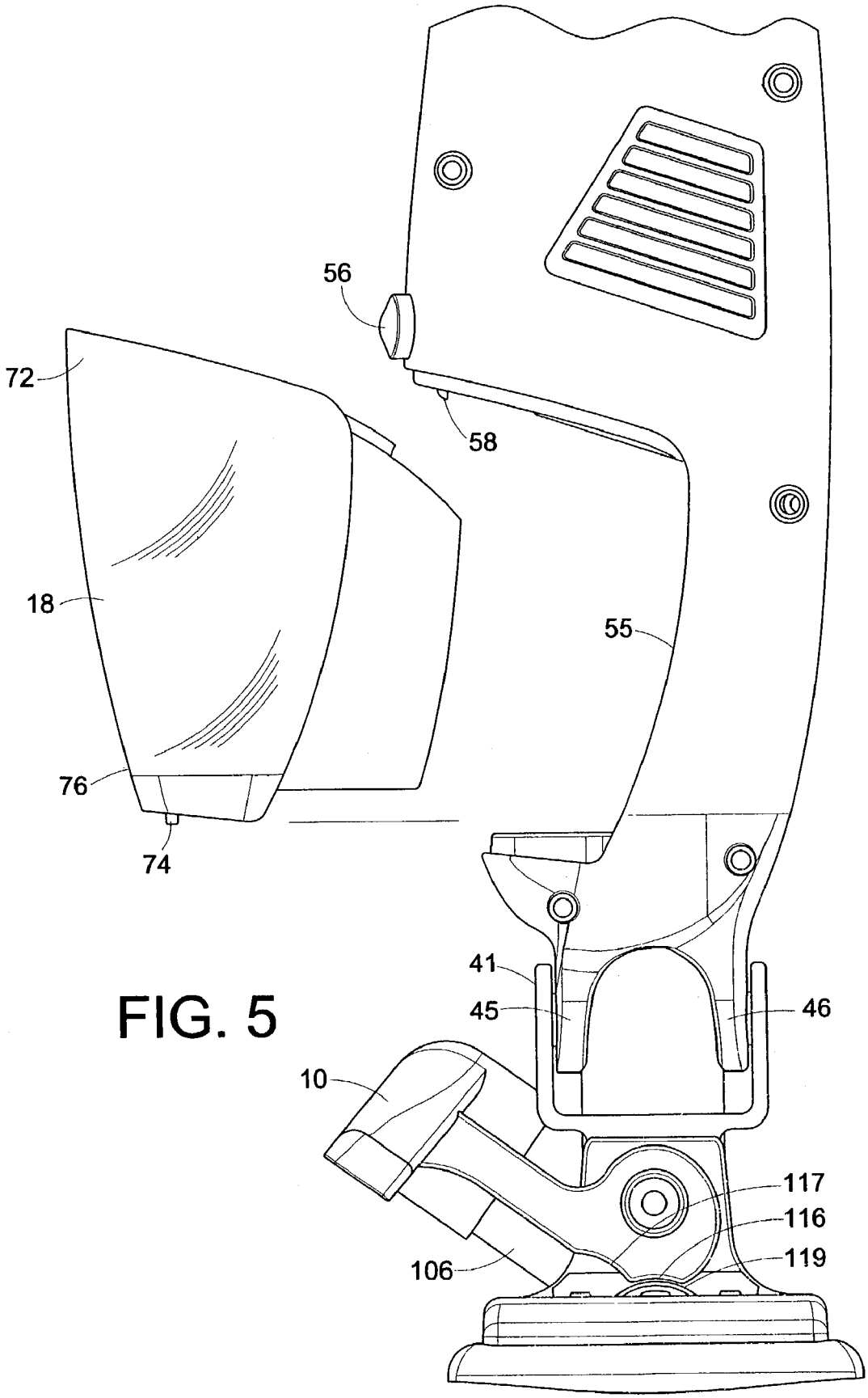
FIG. 5 is an enlarged, exploded side elevational view of the vacuum cleaner of FIG. 3 with the suction nozzle in a tilted upward position to provide access to the cleaning sheet and a dirt cup removed.

Referring again to FIG. 10, the suction nozzle 10 is pivotably connected to the support plate via a pair of spaced apart arms 106, 108 which extend from a rear end 110 of the nozzle. The arms 106, 108 each have a hole 112, 114 respectively through which pins 50 extend to rotatably secure the suction nozzle to the support plate. With reference now to FIG. 5, each of the arms has a pair of adjacent concave sections 116, 117 defined in a lower surface thereof. The sections can each engage or ride upon a resilient detent 119, 120 provided on respective sides of the support plate top surface 21. The detents can snap into respective slots 121, 122 located on the top surface 21 of the support plate. The suction nozzle is manually pivoted or rotated to one of two positions, a "down" or operating position, shown in FIG. 3 and an "up" or non-operating position, shown in FIG. 5. The sections ride along the detents until the suction nozzle is locked into one of the two positions. In the operating position, the suction nozzle is substantially parallel to the surface to be cleaned for vacuuming. The non-operating position enables the support plate and cleaning sheet to clean a surface without the nozzle interfering with or blocking access to the surface to be cleaned. Also, the sheet 30 can, if dirty, be removed and replaced when the nozzle is in the up position.

With reference again to FIG. 6, the hose 100 is positioned adjacent, and can be seated within, a curved portion 124 of the support plate 20. The hose is also bent or curved to extend from an approximately horizontal orientation adjacent the outlet of the suction nozzle to an approximately vertical orientation adjacent inlet 118 (FIG. 9) of the housing. As shown in FIG. 7, inlet 118 is positioned adjacent inlet 80 of the dirt cup. The hose extends through the universal joint assembly as best seen in FIGS. 6 and 10.

When the vacuum cleaner is in use, the air follows a short and efficient flow path. Referring again to FIG. 7, dirt laden air is drawn in through a suction inlet 126 of the suction nozzle and moves up through the suction nozzle, and out the suction nozzle outlet 102 (FIG. 6) into the conduit or flexible hose 100. The dirt laden air is then drawn through the hose and into the inlet 118 of the housing to the inlet duct 80 of the dirt cup. A seal (not illustrated) can provide an effective seal between the conduit and the inlet duct of the dirt cup. The air is then drawn up into the dirt cup through the valve 86 and enters the dirt cup cavity. Heavier dirt particles fall by gravity down towards a base wall 127 of the dirt cup. Lighter particles are drawn up towards the filter cloth 94 as the air is pulled into the interior via the filter assembly. The filter medium or cloth traps smaller dirt particles that have not fallen to the base of the dirt cup. These, then either fall towards the base wall 127 or are held in or on the filter medium.

Figure 11:
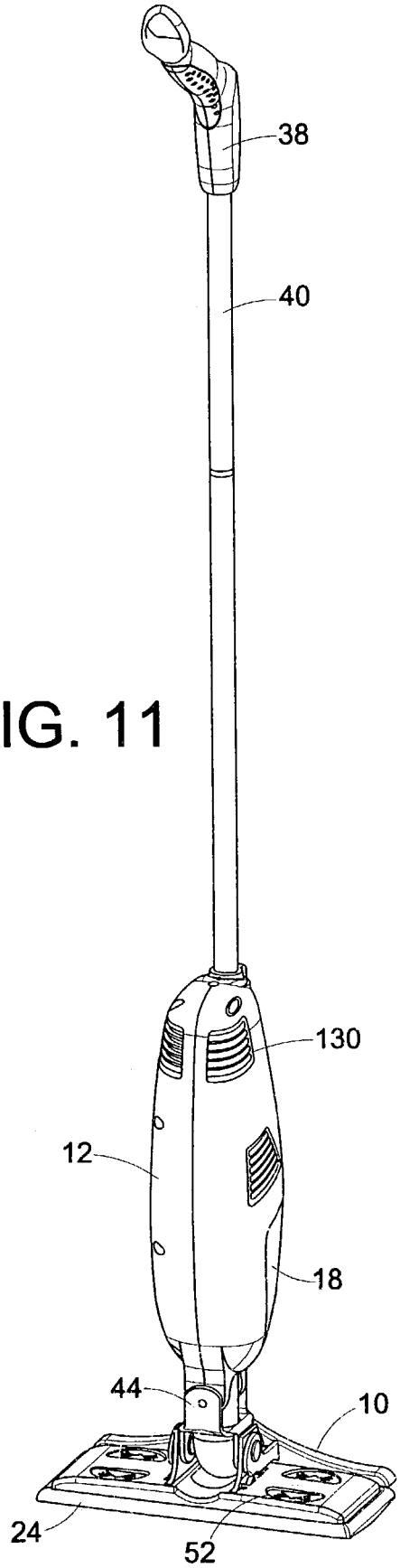
FIG. 11 is a rear perspective view of the vacuum cleaner of FIG. 1.

Substantially clean air is then drawn into the interior of the filter assembly and passes through the dirt cup outlet 81 via opening 97 in the first end wall 96 of the filter cage. Once air passes through the outlet and enters the suction fan 16 through fan inlet 83, clean air is then blown into the motor chamber, across the motor assembly and out through vents 130 (FIGS. 3 and 11) defined in the housing. The filter assembly, the exhaust duct of the dirt cup, the fan inlet, and the suction fan and motor assembly can all be aligned along a longitudinal axis to promote efficient air flow. The entire housing 12 can be made from a suitable conventional thermoplastic material if desired.

With continued reference to FIG. 7, to operate the suction fan and motor assembly 16, an assembly switch 140 is provided on one of the handle and the motor housing. In one embodiment, the switch is located on the handle. The switch assembly includes a button 142 located on the grip 38 of the handle 40. The button 142 is manually depressed to activate a micro switch 144 in the housing. A linkage connects the button 142 to the microswitch 144. The linkage can include a first elongated rod 146 and a second elongated rod 147 which extend in an end to end relationship through handle 40. By using a pair of elongated rods, along with spring assemblies 148, 149, no electrical power is lost between the microswitch 144 and the motor assembly. Button 142 is depressed which in turn moves rod 146 and rod 147 thus depressing microswitch 144. The microswitch completes a circuit which in turn powers the suction fan and motor assembly. The switch assembly thus operably connects the manually accessible button 142 to the microswitch 144 within the housing for powering the suction fan and motor assembly. The switch 140 can be spring biased to an "off" position by springs 148 and 149. Thus, when the user manually depresses the switch to an "on" position, the circuit is completed and power is provided to the suction fan and motor causing them to operate. The switch however only provides momentary operation of the suction fan and motor and as soon as the user stops depressing the switch button it is biased back to the "off" position and the suction fan and motor are shut off.

If desired, a battery pack 152 (FIG. 7) can be used to provide power to the suction fan and motor. The suction fan and motor 16 produce a suction air flow when the button 142 is depressed.

Alternatively, the switch 140 can be of a conventional "rocker" type, in which the switch is clicked to either an "on" position or an "off" position. In this embodiment, to operate the suction fan and motor, switch 140 is depressed or moved to the "on" position and then clicks or locks into place, thus providing continuous operation of the suction fan and motor assembly. To shut off the suction fan and motor assembly, the switch would be depressed to an "off" position and clicks or locks into place. This prevents any further operation of the suction fan motor until the switch is again depressed.

Figure 12:
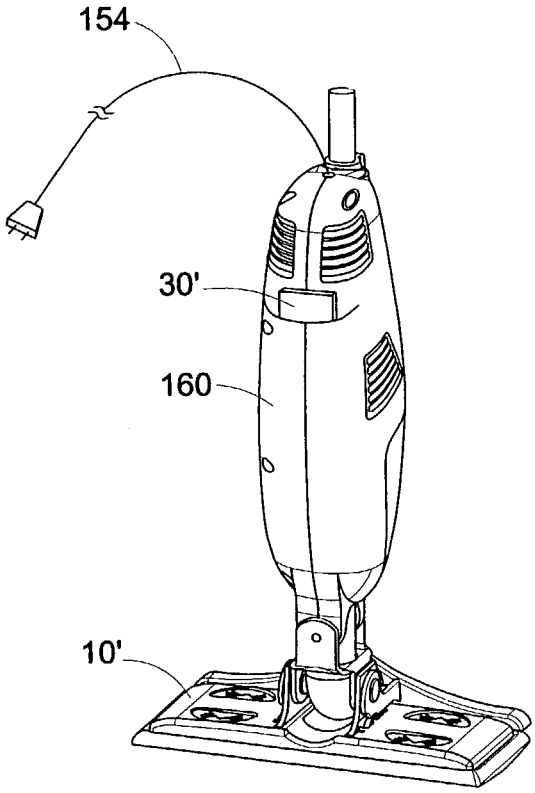
FIG. 12 is a rear perspective view of another embodiment of a vacuum cleaner according to the present invention, including a pocket for holding extra cleaning sheets.

Referring now to FIG. 12, according to another embodiment of the present invention, a pocket 160 can be provided on a rear portion of a housing 12' for accommodating extra cleaning sheets 30'. Also, alternating current (AC) can be provided via a power cord 154 to a suction fan and motor and switch assembly of the vacuum cleaner.

Figure 19A:
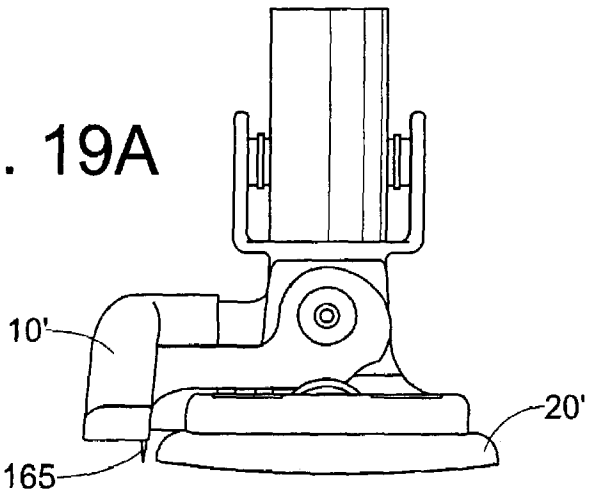
FIG. 19A is a side elevational view of the suction nozzle of FIG. 19.
Figure 19:
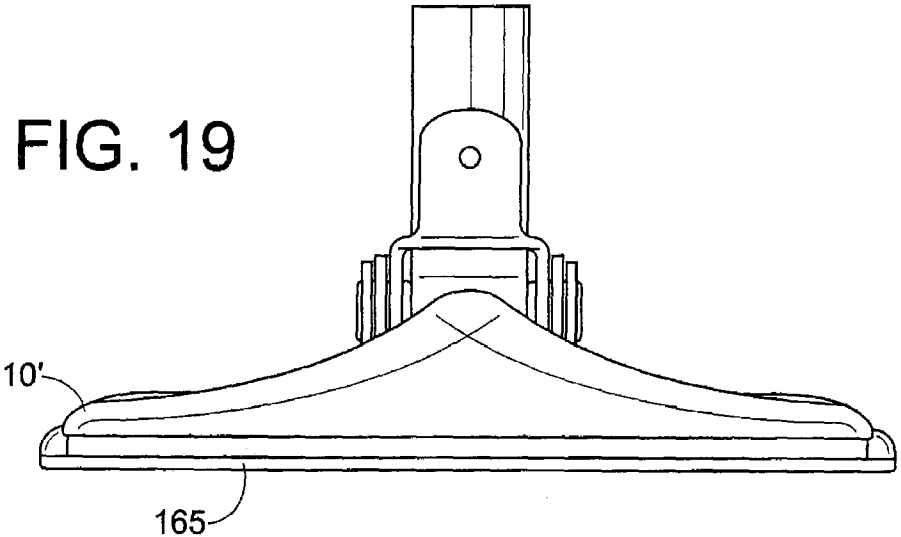
FIG. 19 is an enlarged front elevational view of a suction nozzle of the vacuum cleaner of FIG. 12, including a wiper blade extending therefrom.

Referring now to FIGS. 19 and 19A, a suction nozzle 10' can include a wiper blade 165, which extends along a length of the suction nozzle behind a suction opening thereof, for wiping the surface to be cleaned of liquids or solid particles disposed on the surface. The blade 165 also protects a cleaning sheet (not shown) which is attached to a support plate 20', by blocking larger particles of debris from contacting the cleaning sheet, thus preventing abrasions or tearing of the cleaning sheet.

Figure 13:
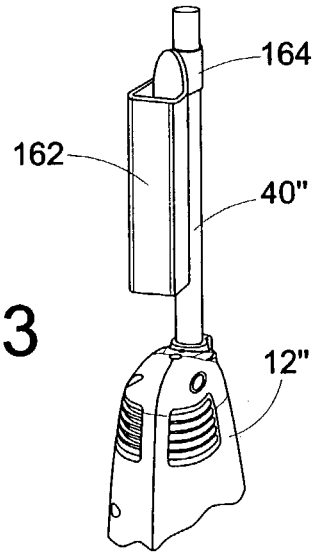
FIG. 13 is a rear perspective view of still another embodiment of a vacuum cleaner according to the present invention, with a caddy for storing extra cleaning sheets.
Figure 20A:
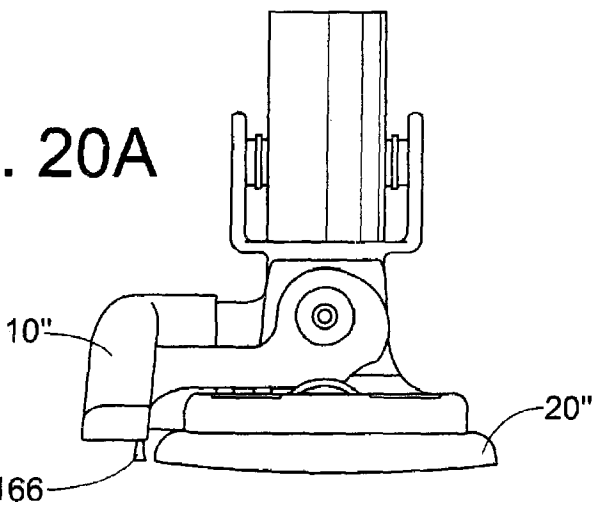
FIG. 20A is a side elevational view of the suction nozzle of FIG. 20.
Figure 20:
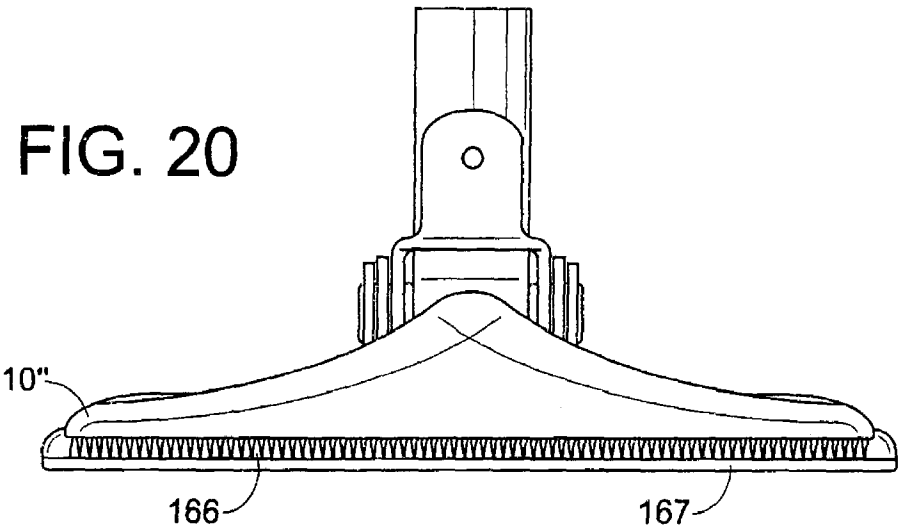
FIG. 20 is an enlarged front elevational view of a suction nozzle of the vacuum cleaner of FIG. 13, including bristle tufts extending therefrom.

In another embodiment, referring to FIG. 13, a caddy 162 can be clipped or otherwise secured onto a handle 40" mounted on a housing 12" via a clip 164. The caddy can accommodate extra cleaning sheets. Referring to FIGS. 20 and 20A, in this embodiment, a suction nozzle 10" can include a bristle tuft assembly 166 having a series of tufts 167 extending along a length of the suction nozzle. The tufts help sweep particles of debris from the surface to be cleaned and prevent debris from contacting a cleaning sheet (not shown) attached to a support plate 20" which could cause damage to the cleaning sheet, such as abrasions or tearing.

Figure 14:
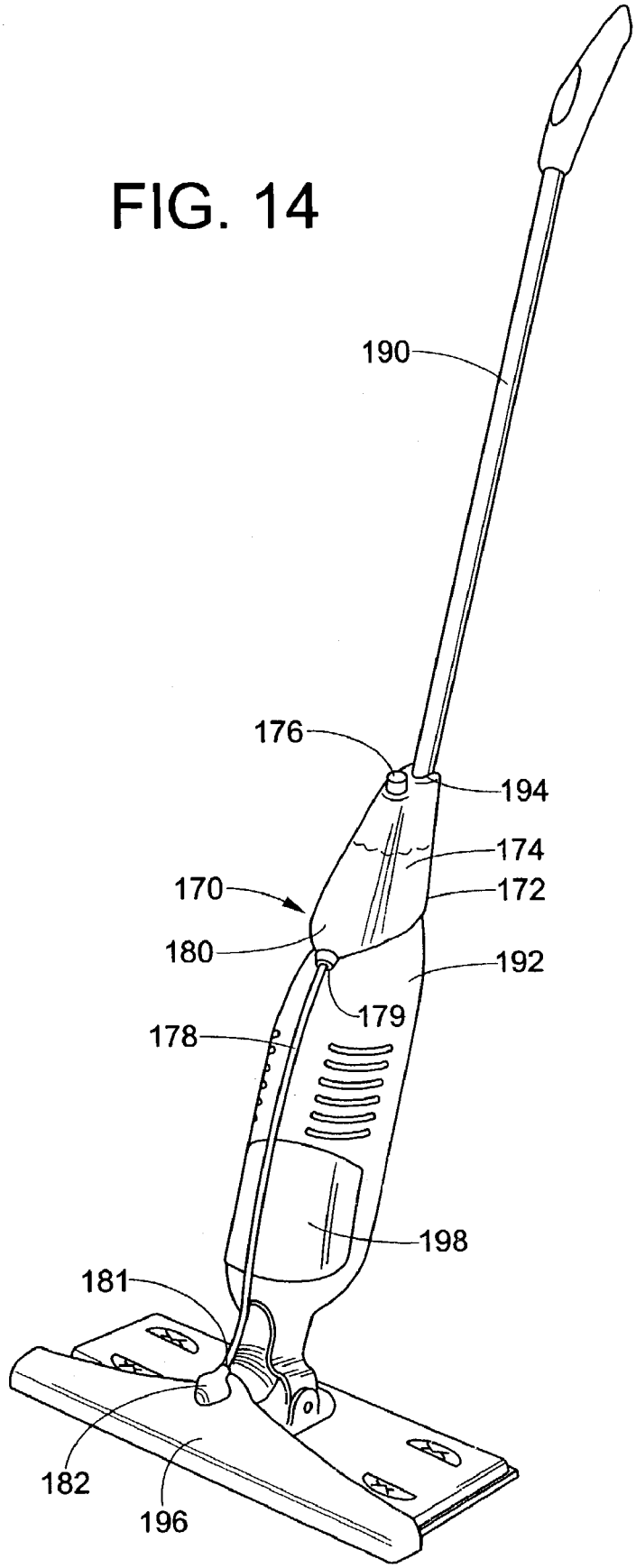
FIG. 14 is a perspective view of yet another embodiment of a vacuum cleaner according to the present invention, having a cleaning solution distribution system attached thereto.

Referring now to FIG. 14, a cleaning solution distribution system 170 can be selectively mounted on a vacuum cleaner of the type shown in FIGS. 1–11. The cleaning solution distribution system can include a cleaning solution bottle 172 containing a cleaning solution 174, and a removable cap 176. The cap 176 can be threadably secured to the bottle and is used to add cleaning solution to the bottle. If desired, the cap can also include a control for a conventional valve system (not shown) that selectively allows a flow of the cleaning solution 174 out of the bottle 172. To this end, a tube 178 has a first end 179 connected to an end 180 of the bottle. A second end 181 of the tube is connected to a sprayer head 182 which sprays or discharges the cleaning solution onto a surface to be cleaned. The bottle can be selectively snapped onto a handle 190 of the vacuum cleaner, directly above a housing 192 thereof. To this end, a longitudinally extending groove 194 can be located on a rear side of the bottle 172. The sprayer head 182 can be adhesively or otherwise secured to a nozzle 196 of the vacuum cleaner. A dirt cup 198 of the vacuum cleaner can be removed from the housing 192 by pushing the hose 178 out of the way or by simply unsnapping the bottle 172 from the handle 190.

Alternatively, a siphoning pump or a valve (not shown) can be connected to a trigger (not shown) on grip 38 to control the flow of cleaning solution from the bottle to the sprayer head. The cleaning solution is sprayed in front of the suction nozzle 196. A suitable cleaning sheet (not shown) having an absorbent layer attached to an outer layer, as is known in the art, can absorb most of the cleaning solution. In addition, it is possible that some of the solution can be suctioned by the suction nozzle and deposited within the dirt cup 198.

Figure 15:
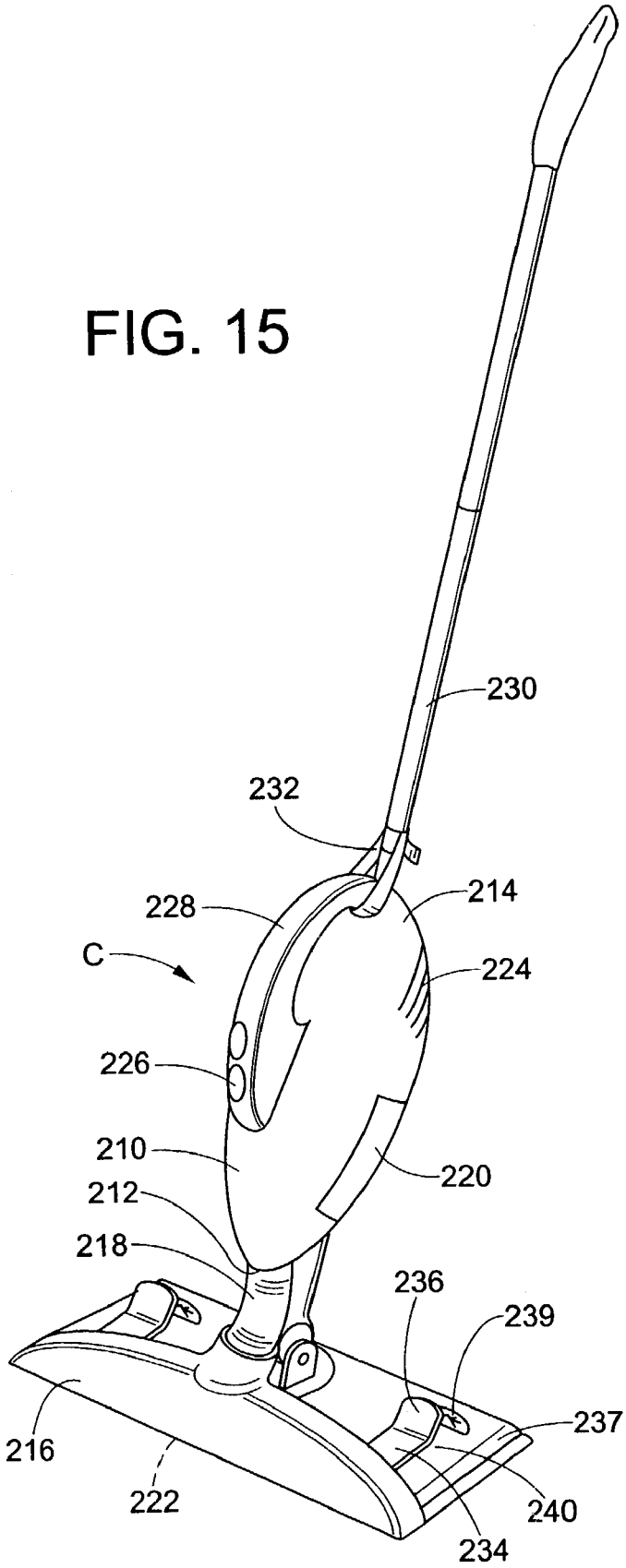
FIG. 15 is a perspective view of a further embodiment of a vacuum cleaner according to the present invention, having a hand-held vacuum cleaner mounted to a conventional cleaning implement having a handle, a support plate and a cleaning sheet.

According to yet another embodiment of the present invention, a portable hand held vacuum cleaner can be selectively mounted to a conventional cleaning implement. Referring to FIG. 15, a hand held vacuum cleaner C includes a housing 210 having a first end 212 and a second end 214. A suction nozzle or head 216 is selectively connected to the housing first end 212 via a conduit such as a flexible hose 218. A dirt cup or container 220 is detachably mounted on the housing. The conduit extends from an outlet of the suction nozzle 216 to an inlet of the dirt cup. The suction nozzle further comprises a suction inlet 222. The internal configuration of a hand-held vacuum cleaner of this type is described in U.S. Pat. No. 6,347,428 which is hereby incorporated by reference in its entirety.

As is known, a suction motor and fan are mounted within the housing. A filter assembly is mounted adjacent the dirt cup to filter air before it exits the dirt cup and flows into the motor/fan assembly. Outlet slots 224 are provided on the housing for allowing air to be exhausted from the housing and providing ventilation and pulling of air for the suction motor. A switch 226 is provided on a handle 228 of the hand-held cleaner for selectively powering the motor/fan assembly. The dirt cup can be fabricated from a transparent thermoplastic material to enable the user to see the dirt and debris being collected in the dirt container.

The hand-held cleaner C can be attached to a handle 230 of a conventional cleaning implement such as the SWIFFER™ product, sold by Procter & Gamble, via a strap 232 or other fastening means such as a hook and loop fasteners or a clip. As mentioned, the SWIFFER™ implement is described in detail in U.S. Patent Application Publication US2002/0050016 A1. The suction nozzle 216 can be clipped onto a support plate 237 of the cleaning implement by two clips 234 which have an upwardly turned gripping tab 236 and have projecting members (such as at 238 in FIG. 16A). The projecting members can be used in two of attachment structures 239 on the support plate. A cleaning sheet (not shown) is wrapped around the support plate 237 and then the suction nozzle is clipped onto the support plate.

Figures 16, 16A, 16B:
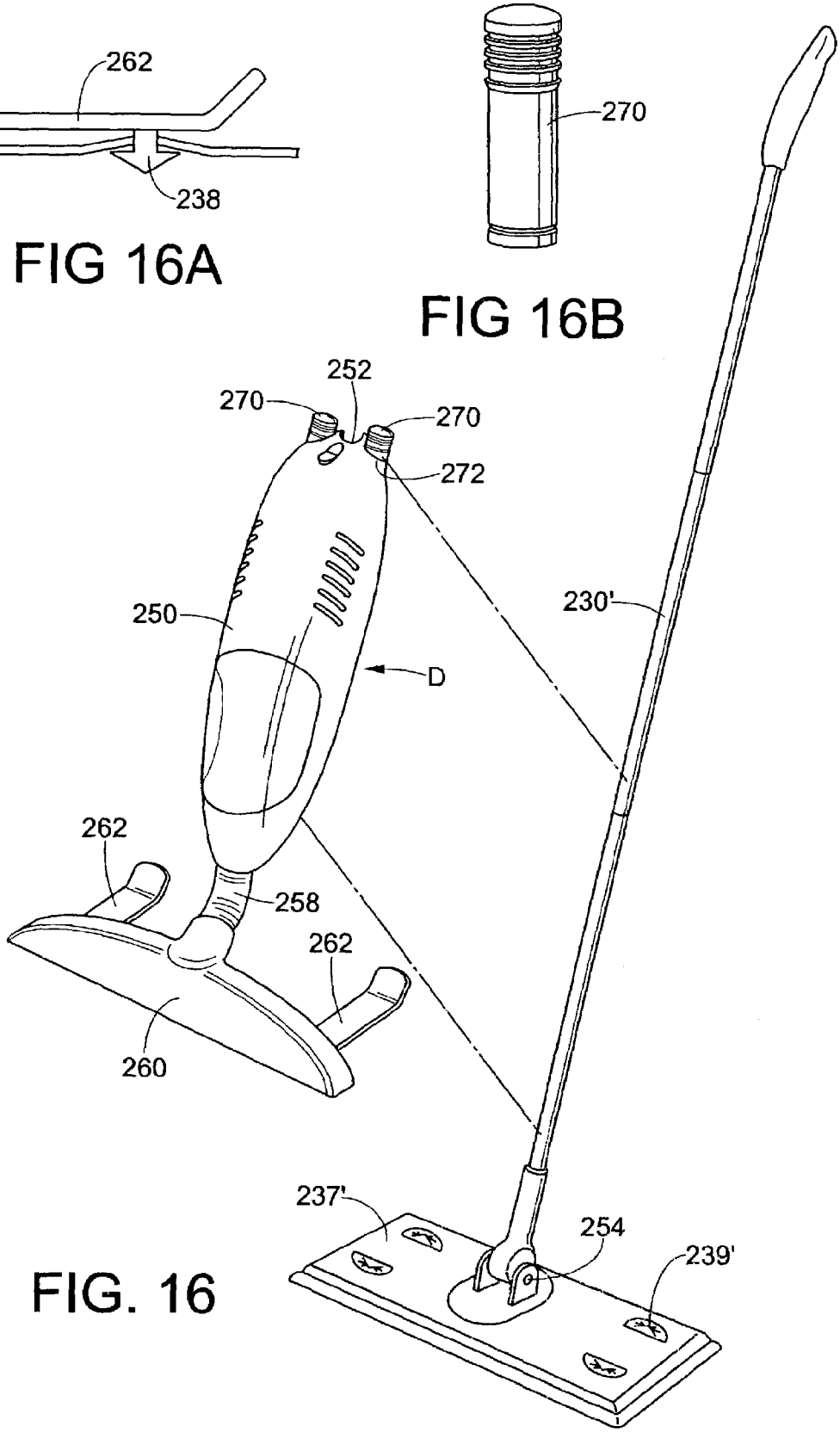
FIG. 16 is an exploded perspective view of a still further embodiment of a vacuum cleaner according to the present invention, having a stick vacuum mounted to the conventional cleaning implement of FIG. 15.
FIG. 16A is an enlarged cross-sectional view of attachment tabs for mounting a suction nozzle of the vacuum cleaner of FIG. 16 onto a support plate.
FIG. 16B is a side elevational view of a battery pack for powering the vacuum cleaner of FIG. 16.

With reference now to FIG. 16, in still yet another embodiment of the present invention, a conventional vacuum cleaner D can be selectively mounted on a handle 230' of a conventional cleaning product. To this end, a housing 250 of the vacuum cleaner can include a longitudinally extending groove 252 on a rear side thereof for selectively accommodating a portion of the handle 230'. The housing would be clipped above a universal joint 254 that connects a support plate 237' to the handle 230'. Connected to the housing 250, via a conduit 258, is a suction nozzle 260. The suction nozzle 260 can be clipped onto the support plate 232' with clips 262. These can have two projecting members 238 per clip (See FIG. 16A). In this embodiment, a cleaning sheet (not shown) is mounted to the support plate 237' via clips 239' and then the projecting members 238 are pushed through the clips 239', trapping the sheet in place and securing the suction nozzle to the support plate. When the sheet needs to be replaced because it is dirty, the clips 262 are first removed. Then, the sheet can be detached from the clips 239' of the support plate. In this embodiment, a removable battery pack 270 (FIG. 16B), such as the VERSAPAK™ product sold by Black & Decker, can be inserted into a slot 272 in housing 250 and provides power to the suction fan and motor assembly within housing 250. Two such battery packs 270 are shown. These can be removed from slots 272 and recharged as necessary.

Figure 17:
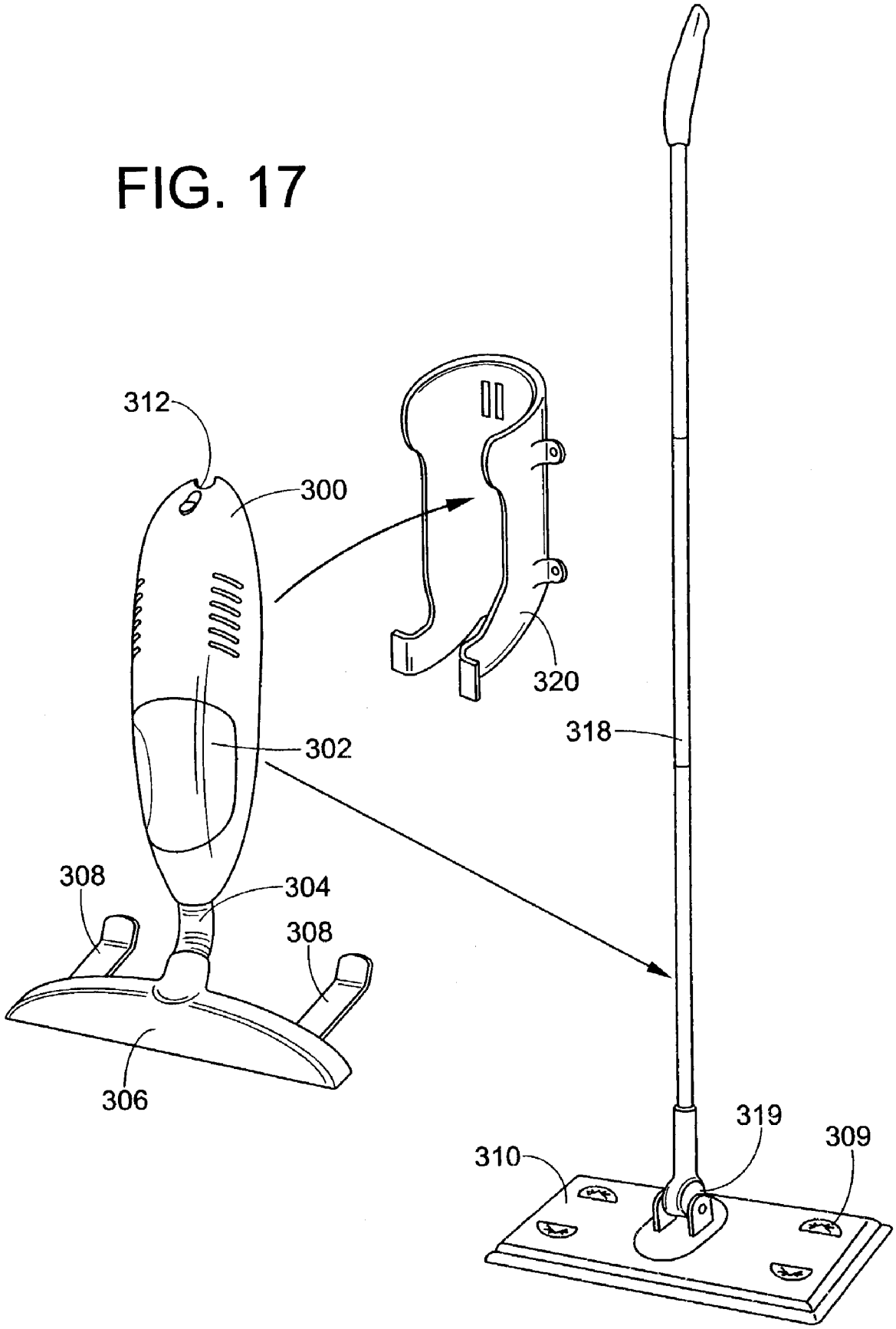
FIG. 17 is an exploded perspective view of yet another embodiment of a vacuum cleaner according to the present invention which is charged by a wall-mounted charger.

With reference now to FIG. 17, a further embodiment of the present invention comprises a vacuum cleaner including a housing 300 having a dirt cup 302 mounted thereon. A conduit 304 extends between the housing 300 and a suction nozzle 306. The housing has a longitudinally extending groove 312 on a rear side thereof for selectively accommodating a portion of the handle 318. The housing is clipped above a universal joint 319 that connects a cleaning pad 310 to the handle 318.

The suction nozzle can be clipped onto the cleaning pad 310 with clips 308. These can have two projecting members (of the type shown in FIG. 16A) per clip. A cleaning sheet (not shown) is mounted to the cleaning pad via clips 309 and their projecting members are pushed through clips 309, securing the cleaning sheet in place and securing the suction nozzle to the cleaning pad.

In this embodiment, for recharging, the housing 300 is selectively detached from the handle 318 and mounted onto a wall-mounted charger 320 which has electrical contacts (not shown) which recharge a battery pack or other power source (not shown) located within the housing 300.

Figure 18:
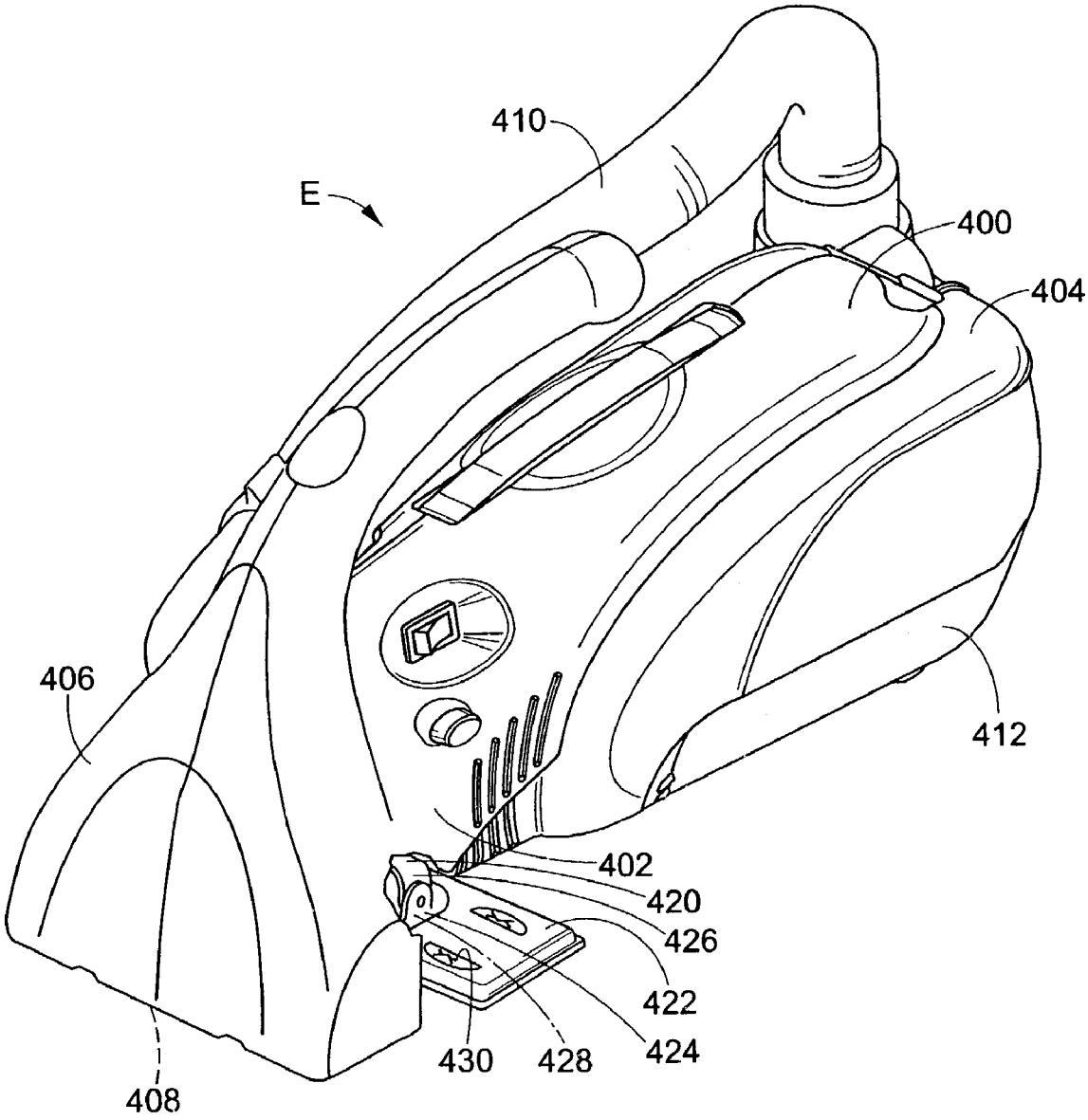
FIG. 18 is a perspective view of still another embodiment of a vacuum cleaner according to the present invention, including a hand-held cleaner having a cleaning pad mounted thereto.

Referring now to FIG. 18, a still further embodiment of a vacuum cleaner according to the present invention is shown. A portable hand-held cleaner E includes a housing 400, having a first end 402 and a second end 404. The first end 402 can have a slot (not shown) for selectively receiving a detachable suction head 406 having a suction opening 408. Alternatively, the head 406 can be permanently mounted to the housing 400. A conduit 410 such as a flexible hose, connects the suction head to the housing. A suction fan and motor assembly (not shown) are mounted within housing 400. A dirt cup 412 is removably attached to a rear portion of the housing.

At least one stem 420 extends from an underside of the housing for connecting a support plate 422 to the housing via a joint 424. The joint can be a universal joint or another suitable joint for this purpose. Stem 420 has a flange 426 which is mounted to a fork 428 of the joint. The fork 428 is interconnected with the support plate and pivotally secures the support plate to the housing. Clips 430 secure a cleaning sheet (not shown) to the support plate 422.

The invention has been described with reference to several preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A vacuum cleaner comprising:
a suction nozzle;
a housing connected to said suction nozzle;
a suction fan and motor assembly mounted to said housing;
a dirt collecting receptacle mounted to said housing and in communication with said suction nozzle and suction fan and motor assembly; and,
a support plate mounted to said housing, said support plate selectively holding a cleaning sheet for collecting dust and debris from a surface to be cleaned, wherein said suction nozzle is pivotable in relation to said support plate.

2. The vacuum cleaner of claim 1, further comprising a conduit extending between said suction nozzle and said dirt collecting receptacle.

3. The vacuum cleaner of claim 1, wherein said support plate is pivotably connected to said housing via a universal joint.

4. The vacuum cleaner of claim 1, further comprising a pair of detents for locking said suction nozzle in one of an operating position and a non-operating position.

5. The vacuum cleaner of claim 1, further comprising a handle extending from said housing.

6. The vacuum cleaner of claim 5, further comprising a power switch located on said handle for controlling operation of the suction fan and motor assembly.

7. The vacuum cleaner of claim 5, further comprising a spray nozzle mounted to said suction nozzle and a cleaning solution container mounted to said handle for distributing cleaning solution to a surface to be cleaned.

8. The vacuum cleaner of claim 1, further comprising a power switch located on said housing for controlling operation of said suction fan and motor assembly.

9. The vacuum cleaner of claim 1, further comprising a means for holding at least one extra cleaning sheet.

10. The vacuum cleaner of claim 1, further comprising a plurality of bristles mounted to said suction nozzle.

11. A vacuum cleaner comprising:
a suction nozzle;
a housing connected to said suction nozzle;
a suction fan and motor assembly mounted to said housing;
a dirt collecting receptacle mounted to said housing and in communication with said suction nozzle and suction fan and motor assembly;
a support plate pivotally mounted to said housing, said support plate selectively holding a cleaning sheet for collecting dust and debris from a surface to be cleaned;
a conduit extending between said suction nozzle and said dirt collecting receptacle; wherein said conduit comprises a flexible hose.

12. The vacuum cleaner of claim 11, wherein said dirt collecting receptacle comprises a filter bag.

13. The vacuum cleaner of claim 11, wherein said dirt collecting receptacle comprises a dirt cup.

14. The vacuum cleaner of claim 13, further comprising a latch for selectively securing said dirt cup to said housing.

15. The vacuum cleaner of claim 13, wherein said dirt cup comprises an inlet and an outlet, wherein said inlet communicates with an outlet of said suction nozzle and said dirt cup outlet communicates with an inlet of said suction fan and motor assembly.

16. The vacuum cleaner of claim 15, further comprising a filter detachably mounted to said dirt cup.

17. A vacuum cleaner comprising:
a suction nozzle;
a housing connected to said suction nozzle;
a suction fan and motor assembly mounted to said housing;
a dirt collecting receptacle mounted to said housing and in communication with said suction nozzle and suction fan and motor assembly; and,
a support plate pivotally mounted to said housing, said support plate selectively holding a cleaning sheet for collecting dust and debris from a surface to be cleaned, wherein said cleaning sheet comprises electrostatic material.

18. The vacuum cleaner of claim 17, wherein said support plate comprises a convex surface.

19. The vacuum cleaner of claim 17, wherein said support plate comprises a top surface having at least one clip for securing said cleaning sheet to said support plate.

20. The vacuum cleaner of claim 17, further comprising a wiper blade mounted to an edge of said suction nozzle.

21. The vacuum cleaner of claim 17, wherein said suction nozzle is pivotable in relation to said support plate.

22. The vacuum cleaner of claim 17, further comprising a flexible hose for fluidly connecting said suction nozzle and said dirt collecting receptacle.

23. A vacuum cleaner comprising:
a suction nozzle;
a wiper blade mounted to said suction nozzle;
a housing connected to said suction nozzle;
a suction fan and motor assembly mounted to said housing;
a dirt collecting receptacle mounted to said housing and in communication with said suction nozzle and suction fan and motor assembly; and,
a support plate pivotally mounted to said housing, said support plate selectively holding a cleaning sheet for collecting dust and debris from a surface to be cleaned.

24. The vacuum cleaner of claim 23, wherein said wiper blade is disposed adjacent a rear edge of said nozzle.

25. The vacuum cleaner of claim 23, wherein said cleaning sheet comprises an electrostatic material.

26. The vacuum cleaner of claim 23, further comprising a flexible hose for fluidly connecting said suction nozzle and said dirt collecting receptacle.

27. A vacuum cleaner comprising:

a support plate selectively holding a cleaning sheet;

a handle pivotably connected to said support plate;

a housing mounted to one of said handle and said support plate;

a suction fan and motor assembly mounted to said housing;

a dirt collecting receptacle mounted to said housing; and a suction nozzle pivotably connected to said support plate.

28. The vacuum cleaner of claim 27, wherein said dirt collecting receptacle comprises a dirt cup.

29. The vacuum cleaner of claim 27, wherein said housing is selectively secured to said handle via at least one clip.

30. The vacuum cleaner of claim 27, wherein said support plate is pivotally connected to said handle via a universal joint.

31. The vacuum cleaner of claim 27, further comprising a power switch for controlling operation of the suction fan and motor assembly.

32. The vacuum cleaner of claim 27, wherein said suction nozzle is removably secured to said support plate via at least one clip.

33. The vacuum cleaner of claim 32, wherein said at least one clip is mounted on said support plate and also serves to selectively secure said cleaning sheet to said support plate.

34. A vacuum cleaner comprising:

a suction nozzle;

a housing connected to said suction nozzle;

a suction fan and motor assembly mounted to said housing;

a dirt collecting receptacle mounted to said housing and in communication with said suction nozzle and said suction fan and motor assembly;

a handle extending from said housing for grasping to move said vacuum cleaner along a surface to be cleaned;

a switch for providing at least momentary operation of said suction fan and motor assembly, wherein said switch is spring-biased to an off position; and, a support plate pivotally mounted to said housing, said support plate selectively holding a cleaning sheet for collecting dust and debris from a surface to be cleaned.

35. The vacuum cleaner of claim 34, wherein said switch is located on said handle.

36. The vacuum cleaner of claim 34, wherein said switch is located on said housing.

37. The vacuum cleaner of claim 36, further comprising a linkage connecting a button mounted on said handle with said switch.

38. The vacuum cleaner of claim 34, further comprising a source of electrical power operatively connected to said switch for operating said suction fan and motor assembly.

39. A cleaning device having two separate and distinct selective modes of operation, which include a first mode of operation comprising suctioning debris from a surface to be cleaned, and a second mode of operation comprising use of a cleaning sheet to collect dust and debris from the surface to be cleaned, said cleaning device comprising:

a housing;

a suction fan and motor assembly mounted to said housing;

a dirt collecting receptacle mounted to said housing; and, a suction nozzle communicating with said suction fan and motor assembly and said dirt receptacle for performing said first mode of operation;

a support plate mounted to said housing, wherein said support plate is pivotable in relation to said suction nozzle and wherein said support plate selectively holds a cleaning sheet for performing said second mode of operation.

40. The vacuum cleaner of claim 39, wherein said cleaning sheet comprises electrostatic material.

41. The vacuum cleaner of claim 39, wherein said cleaning sheet is pre-wetted with cleaning solution.

42. The vacuum cleaner of claim 39, wherein said dirt collecting receptacle comprises a dirt cup.

43. A vacuum cleaner comprising:

a housing;

a suction fan and motor mounted to said housing;

a handle connected to said housing;

a first cleaning implement pivotally connected to said housing;

a second cleaning implement pivotally connected to said housing wherein said second cleaning implement is located behind said first cleaning implement: and, a dirt collecting receptacle mounted to said housing and in communication with said suction fan and motor assembly;

wherein said second cleaning implement comprises a support plate; and, a cleaning sheet selectively secure to said support plate via at least one clip.

44. The vacuum cleaner of claim 43, wherein said first cleaning implement comprises a suction nozzle.

45. The vacuum cleaner of claim 44, wherein said suction nozzle is connected to said housing via a universal joint.

46. The vacuum cleaner of claim 45, wherein said suction nozzle is pivotable in relation to said universal joint.

47. The vacuum cleaner of claim 43, wherein said dirt collecting receptacle comprises a dirt cup.

48. The vacuum cleaner of claim 43, wherein said support plate is connected to said housing via a universal joint.

* * * * *